US010470491B2

(12) United States Patent
Sutton et al.

(10) Patent No.: US 10,470,491 B2
(45) Date of Patent: Nov. 12, 2019

(54) INHALATION DEVICE AND COMPONENT FOR AN INHALATION DEVICE

(71) Applicant: British American Tobacco (Investments) Limited, London (GB)

(72) Inventors: Joseph Sutton, London (GB); Rabya Khan-Dar, London (GB); Carl Clement, London (GB); Simon James Smith, Cambridge (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 869 days.

(21) Appl. No.: 14/771,086

(22) PCT Filed: Feb. 24, 2014

(86) PCT No.: PCT/GB2014/050544
§ 371 (c)(1),
(2) Date: Aug. 27, 2015

(87) PCT Pub. No.: WO2014/132044
PCT Pub. Date: Sep. 4, 2014

(65) Prior Publication Data

US 2016/0007648 A1 Jan. 14, 2016

(30) Foreign Application Priority Data

Feb. 27, 2013 (GB) ..... 1303437.6

(51) Int. Cl.
*A24F 13/06* (2006.01)
*A24F 7/02* (2006.01)
*A24F 13/02* (2006.01)

(52) U.S. Cl.
CPC ..... *A24F 13/06* (2013.01); *A24F 7/02* (2013.01); *A24F 13/02* (2013.01)

(58) Field of Classification Search
CPC .. A24F 7/02; A24F 13/02; A24F 13/04; A24F 13/06; A61M 15/06; A61M 15/009
See application file for complete search history.

(56) References Cited

U.S. PATENT DOCUMENTS 2,153,623 A 4/1939 Jacobson
2,956,568 A * 10/1960 Knudsen ..... A24F 1/00 131/182

(Continued)

FOREIGN PATENT DOCUMENTS

CN 2262810 9/1997
CN 2686350 3/2005

(Continued)

OTHER PUBLICATIONS

International Search Report and Written Opinion for International Application No. PCT/GB2014/050545 dated Oct. 8, 2014.

(Continued)

*Primary Examiner* — Michael H. Wilson
*Assistant Examiner* — Yana B Krinker
(74) *Attorney, Agent, or Firm* — Patterson Thuente Pedersen, P.A.

(57) ABSTRACT

A component for an inhalation device having a first end for connection to a body of an inhalation device and a second end. A passage extends through the component from the first end to the second end for the flow of inhalant therethrough. The first end includes a blind cavity, separate to the passage and containing an organoleptic material. Also, an inhalation device comprising a body with a first end connected to such a component of the inhalation device and, a second end configured to receive an inhalant-generating component, is disclosed. A conduit extends through the body between the first and second ends.

29 Claims, 24 Drawing Sheets

(56) References Cited

U.S. PATENT DOCUMENTS

| | | | | | |
|---|---|---|---|---|---|
| 3,339,557 | A | | 9/1967 | Karalus | |
| 3,468,316 | A | | 9/1969 | Baum et al. | |
| 4,038,994 | A | | 8/1977 | Aikman | |
| 4,227,540 | A | | 10/1980 | Edison | |
| 4,478,228 | A | * | 10/1984 | Chister | A24F 3/02 131/180 |
| 4,484,590 | A | * | 11/1984 | Singh | A24F 1/26 131/180 |
| 4,559,955 | A | | 12/1985 | Brockway et al. | |
| 4,637,407 | A | | 1/1987 | Bonanno et al. | |
| 4,677,995 | A | | 7/1987 | Kallianos | |
| 4,848,375 | A | | 7/1989 | Patron et al. | |
| 4,945,931 | A | | 8/1990 | Gori | |
| 4,991,605 | A | | 2/1991 | Keritsis | |
| 6,336,896 | B1 | | 1/2002 | Hsu | |
| 7,658,197 | B1 | | 2/2010 | Villagomez | |
| 2004/0237974 | A1 | | 12/2004 | Min | |
| 2005/0126568 | A1 | * | 6/2005 | Davies | A61M 15/0045 128/203.12 |
| 2006/0272659 | A1 | | 7/2006 | Kobal et al. | |
| 2008/0053465 | A1 | | 3/2008 | Tarora | |
| 2013/0037042 | A1 | | 2/2013 | Hearn | |
| 2013/0333709 | A1 | | 12/2013 | Kazuhiko | |
| 2016/0007648 | A1 | | 1/2016 | Sutton | |
| 2016/0007649 | A1 | | 1/2016 | Sampson et al. | |

FOREIGN PATENT DOCUMENTS

| | | | | | |
|---|---|---|---|---|---|
| CN | 101141892 | | | 3/2008 | |
| CN | 201108029 | | | 9/2008 | |
| CN | 101277621 | | | 10/2008 | |
| CN | 101951796 | | | 1/2011 | |
| CN | 102258219 | | | 11/2011 | |
| DE | 3938634 | A1 | | 6/1990 | |
| DE | 19645563 | | | 5/1998 | |
| DE | 102005016415 | A1 | | 11/2006 | |
| EP | 1609376 | A1 | | 12/2005 | |
| EP | 1859694 | | | 11/2007 | |
| EP | 1859694 | A1 | | 11/2007 | |
| GB | 607728 | A | | 9/1948 | |
| GB | 2299012 | A | * | 9/1996 | A24F 1/00 |
| JP | S64-009598 | | | 1/1989 | |
| JP | H01-098470 | | | 4/1989 | |
| JP | 2009-213428 | | | 9/2009 | |
| JP | 2012075370 | A | | 4/2012 | |
| JP | 2012-135299 | | | 7/2012 | |
| WO | 02/069745 | A1 | | 9/2002 | |
| WO | 2006098171 | A1 | | 9/2006 | |
| WO | WO2007110650 | | | 10/2007 | |
| WO | 2009022232 | A2 | | 2/2009 | |
| WO | 2011095410 | A1 | | 8/2011 | |
| WO | WO2012117578 | | | 9/2012 | |

OTHER PUBLICATIONS

International Preliminary Report on Patentability for International Application No. PCT/GB2014/050545 dated Feb. 27, 2015.
Application and File History for PCT Application No. PCT/GB2014/050545 filed Feb. 24, 2014, inventors Sampson et al.
International Search Report and Written Opinion, dated Sep. 22, 2014, for International Application No. PCT/GB2014/050544.
Japanese Office Action, Application No. 2015-559559, dated Nov. 29, 2016, 4 pages.
Chinese Office Action, Application No. 201480023874.7, dated Mar. 30, 2018, 11 pages (27 pages with translation).
Translation of Chinese Decision to Grant Patent Right for Invention, Application No. 201480023894.4, dated Dec. 4, 2017, 2 pages.
Japanese Office Action, Application No. 2015-559560, dated Sep. 13, 2016, 4 pages (7 pages with translation).
Japanese Decision to Grant, Application No. 2015-559560, dated Apr. 4, 2017, 3 pages (7 pages with translation).
Chinese Office Action, Application No. 201480023894.4, dated Dec. 8, 2016, 8 pages (23 pages with translation).

* cited by examiner

INHALATION DEVICE AND COMPONENT FOR AN INHALATION DEVICE

CLAIM FOR PRIORITY

This application is the National Stage of International Application No. PCT/GB2014/050544, filed Feb. 24, 2014, which in turn claims priority to and benefit of United Kingdom Patent Application No. GB1303437.6, filed Feb. 27, 2013. The entire contents of the aforementioned applications are herein expressly incorporated by reference.

FIELD

In this specification is described an inhalation device and a component for such a device.

BACKGROUND

Inhalation devices are known and include a variety of configurations, including devices for producing a vapour for inhalation by a user such as electronic cigarettes, and aerosol generating devices which produce a vapour or aerosol for inhalation by a user by heating a source material. Also, cigarette holders are known which comprise a body configured to receive a cigarette and through which the cigarette may be smoked. Such devices may include a filter material impregnated with a flavourant such that gas, vapour, aerosol or smoke drawn through the filter picks up the flavour.

SUMMARY

In this specification there are described embodiments of a component for an inhalation device, comprising a first end for connection to a body of an inhalation device and a second end, a passage extending through the component from the first end to the second end for the flow of inhalant therethrough, wherein the first end includes a blind cavity, separate to the passage and containing an organoleptic material.

The organoleptic material may include at least one open hollow space formed therein.

A cam pin may extend inwardly from an inside wall of the component proximate the first end to locate in a corresponding cam groove in a body of an inhalation device to connect the component to the inhalation device.

The organoleptic material may be provided within a casing within the blind cavity of the component.

The organoleptic material may be removable from the component to enable replacement with another portion of organoleptic material.

The component may further comprise a removable cover sealed over the blind cavity to seal the organoleptic material from ambient atmosphere prior to use.

In this specification there are also described embodiments of an inhalation device comprising a body with a first end configured to receive an additional component of the inhalation device and, a second end configured to receive an inhalant-generating component, a conduit extending through the body between the first and second ends, and a component as described above connected to the first end of the body.

The component may be positionable relative to the body in a first position wherein the conduit is in fluid communication with the passage via the blind cavity to define a first inhalant flow path through the inhalation device in which an organoleptic additive may be introduced into the inhalant stream.

The first inhalant flow path may extend through the open hollow space in the organoleptic material.

The component may be moveable relative to the body between the first position and a second position in which the conduit is in fluid communication with the passage to define a second inhalant flow path through the inhalation device, and in which the blind cavity is sealed from the conduit and the passage to prevent introduction of an organoleptic additive into the inhalant stream.

The second inhalant flow path may bypass the organoleptic material.

Inhalant passing along the first inhalant flow path may sweep over the surface of the organoleptic material as it flows within the blind cavity when the component is in the first position.

The component may be rotatable relative to the body between the first and second positions.

The first end of the body may include a cam groove along which the cam pin travels as the component is rotated between the first and second positions.

The cam groove may include a detent into which the cam pin can locate to provide a stable rotational position of the component relative to the body when in at least one of the first and second positions.

The cam groove may be configured such that the component is urged into tighter engagement with the body when the cam pin locates in the detent than when the cam pin is located in the remainder of the cam groove.

The cam groove may comprise a detent corresponding to each of the first and second rotational positions of the component.

The cam groove may include a portion that is open to the first end of the body to allow the component to be connected to, and disconnected from the body.

The first end of the body may include an end face through which the conduit extends, and the end face may further include a recess, wherein the recess in the end face fluidly communicates the blind cavity in the component with the passage in the component, when the component is in the first position.

The first end of the body may include an end face through which the conduit extends, the end face further including a recess, wherein the blind cavity in the component fluidly communicates the conduit with the recess in the end face, when the component is in the first position.

The conduit may be in fluid communication with the passage via the at least one open hollow space in the organoleptic material when the component is in the first position.

The inhalation device may further comprise a carbon-based filter element within the elongate body.

The filter element may be sealed from the organoleptic material when the component is in the second position.

The inhalation device may comprise a ventilation control mechanism configured to selectively allow ambient air to be drawn into the body to mix with the inhalant stream. Control of the introduction of ambient air by the ventilation control mechanism may be independent of the selective introduction of an organoleptic additive into the inhalant stream.

The component may comprise a mouthpiece of an inhalation device.

In this specification there are also described embodiments of an inhalation device comprising a body with a first end configured to receive an inhalant-generating component, and a mouthpiece at an opposite end of the body, the body including a passage therethrough defining an inhalant flow path from the rod to the mouthpiece, and an inhalant modifying mechanism configured to selectively introduce an organoleptic additive to the inhalant prior to inhalation by a user, wherein the inhalant modifying mechanism comprises a control member having a plurality of apertures therethrough, at least one aperture loaded with an organoleptic material, and a blocking element, wherein the control member is moveable between a first position in which gas is permitted to flow through the at least one loaded aperture, and a second position in which the or each loaded aperture is closed by the blocking element so that gas is only permitted to flow through the remaining apertures, when a user draws on the mouthpiece.

The control member may be disposed in the passage such that the inhalant flow path passes through the apertures in the control member.

The control member may be disposed around the outside of the passage and the body may include a ventilation hole to allow ambient air to pass into the body, wherein the inhalant flow path bypasses the control member and ambient air drawn into the body passes through the apertures in the control member and mixes with the inhalant in the mouthpiece.

The organoleptic material in the at least one aperture may be coated on an inside wall of the aperture such that gas flowing through the coated aperture sweeps over the organoleptic material for the additive to become entrained in the gas flow.

In this specification there are also described embodiments of an inhalation device comprising a component comprising a passage extending therethrough and a blind cavity in a first end of the component, separate to the passage, a body having a first end configured for connection to the component, an opposite end configured to receive an inhalant-generating member, and a conduit extending through the body between the first and second ends, wherein the first end of the body includes a sealing face, wherein the component is rotatably connected to the body with the first end of the component in contact with the sealing face of the body, and wherein, in at least one position of the component relative to the body, the blind cavity is sealed closed by the sealing face of the body.

The component may be rotatable relative to the body between a first position in which the conduit is in fluid communication with the passage via the blind cavity to define a first inhalant flow path through the smoking device, and a second position in which the conduit is in fluid communication with the passage to define a second inhalant flow path through the smoking device and in which the blind cavity is sealed closed by the sealing face of the body.

The blind cavity may contain an organoleptic material.

The inhalation device may include any feature or combination of features described above.

In this specification there are also described embodiments of a pack of a plurality of components as described above. The pack may be hermetically sealed, and each component may be individually hermetically sealed from the remaining component(s). The components may comprise mouthpieces for an inhalation device.

In this specification there are also described embodiments of an inhalation device comprising a smoking device configured to receive a rod of smokable material to generate smoke as the inhalant to be drawn through the device by combustion of the tobacco rod.

In this specification there are also described embodiments of an inhalation device configured to receive a vapour generating component comprising tobacco and a heat generator for heating the tobacco without combustion, to generate inhalant vapour to be drawn through the device.

In this specification there are also described embodiments of an inhalation device configured to receive a vapour generating component comprising a reservoir of liquid and a heat generator for heating the liquid to generate inhalant vapour.

The inhalation devices described above may be formed integrally with an inhalant-generating component as described above, or may be configured to removeably receive an inhalant-generating component.

BRIEF DESCRIPTION OF THE DRAWINGS

Embodiments of an inhalation device and a component for an inhalation device will now be described, by way of example only, with reference to the accompanying drawings, in which.

DETAILED DESCRIPTION

Figure 1:
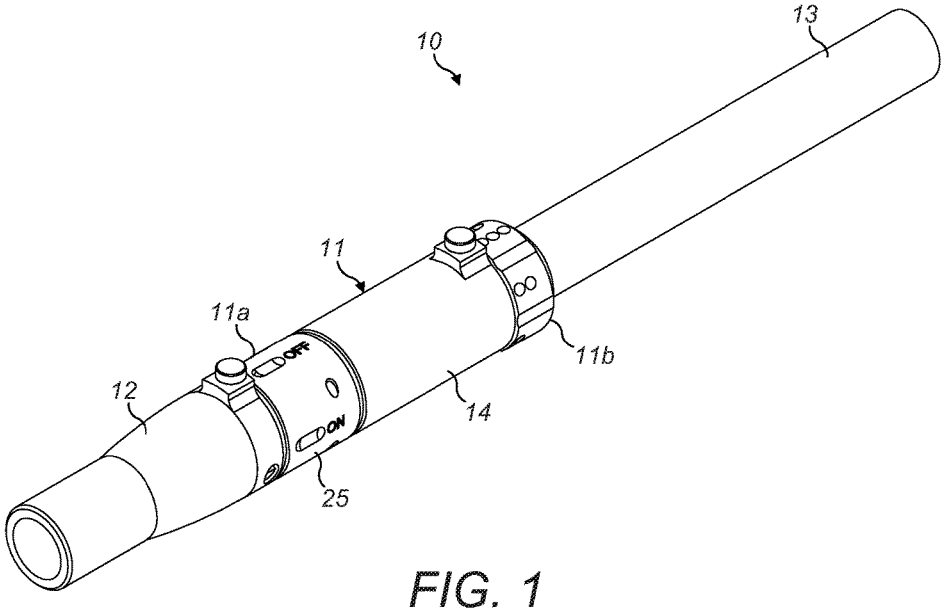
FIG. 1 shows a perspective view of an inhalation device incorporating a mouthpiece of a first embodiment.
Figure 2:
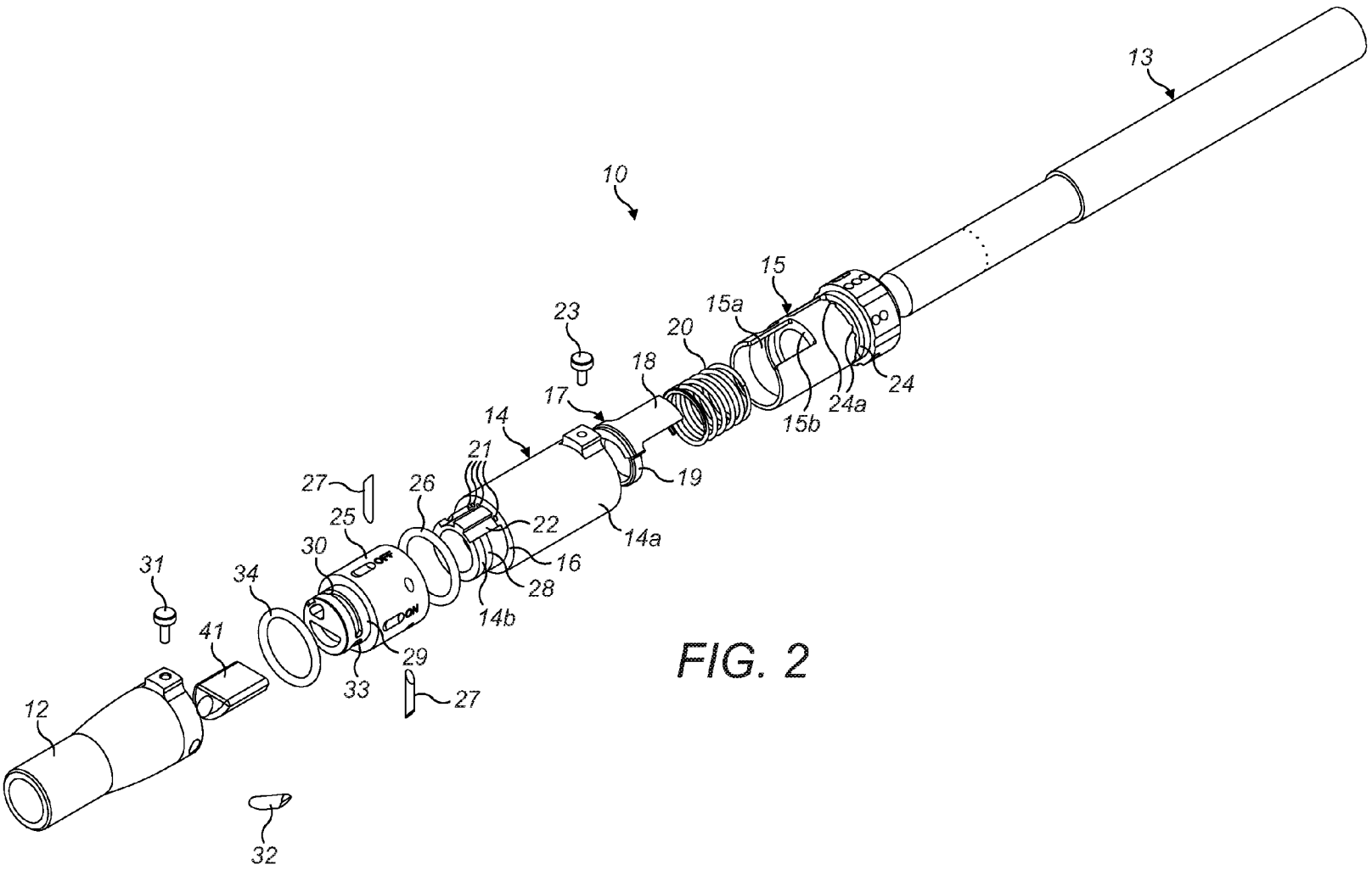
FIG. 2 shows an exploded perspective view of the inhalation device of FIG. 1.

Referring to FIGS. 1-15, a mouthpiece 12 of a first embodiment is shown as part of an inhalation device which, in this first exemplary embodiment, comprises a smoking apparatus 10. The smoking apparatus 10 comprises a controller body 11 and the mouthpiece 12. A combustible tobacco rod 13 can be inserted into the controller body 11. The controller body 11 comprises a first (mouth) end 11*a* and, a second (rod) end 11*b* opposite to the first end. The first and second ends 11*a*, 11*b* are open and are in fluid communication with each other. The controller body 11 includes a connector 25 at the first end 11*a* thereof, and the mouthpiece 12 is removably attachable to the connector 25. The tobacco rod 13 is a single-use component which is received in an aperture in the second end 11*b* of the controller body 11.

In use, the tobacco rod 13 is inserted into the second end 11*b* of the controller body 11 and ignited. A user inhales through the mouthpiece 12 and smoke is drawn through the tobacco rod 13, through the controller body 11 and out of the mouthpiece 12 as the tobacco rod 13 is combusted. When the user has finished smoking, the remaining portion (stub) of the combusted tobacco rod 13 is discarded and a new tobacco rod 13 is inserted for each subsequent use of the apparatus 10.

The controller body 11 is a multi-use component of the apparatus 10, that is, it can be used for the smoking of multiple tobacco rods 13. The mouthpiece 12 is also a multi-use component although can be removed from the controller body 11 and replaced with a new mouthpiece 12 when required.

The controller body 11 comprises a generally cylindrical housing 14 containing a ventilation control sleeve 15 rotatably mounted therein. The cylindrical housing 14 comprises a first portion 14*a* and a second portion 14*b* of a smaller diameter than the first portion 14*a*, extending from one end of the first portion 14*a*. The first portion 14*a* transitions to the second portion at an annular wall 16 which lies in a plane perpendicular to the central axis of the cylindrical housing 14. An end of a tobacco rod 13 to be smoked is held as a friction fit within the bore of the second portion 14*b* when the tobacco rod 13 is fully inserted into the controller body 11.

A control ring 17 is rotatably mounted within the first portion 14*a* of the housing 14 and includes a plate 18 extending in an axial direction from a section of the perimeter of the control ring 17. The plate 18 is received within a correspondingly shaped slot 15*a* in the side wall of the ventilation control sleeve 15 such that rotation of the ventilation control sleeve 15 causes the control ring 17 to rotate. The control ring 17 abuts against the inside of the annular wall 16 of the housing 14, but includes a section of reduced thickness 19 around a portion of the circumference thereof which is spaced from the annular wall 16.

A coil spring 20 is disposed within the cylindrical housing 14 between the control ring 17 and an inner rim 15*b* of the ventilation control sleeve 15. The spring 20 biases the control ring 17 against the annular wall 16 of the housing 14.

The annular wall 16 of the cylindrical housing 14 includes a plurality of ventilation holes 21. Ventilation channels 22 are formed in the second portion 14*b* of the cylindrical housing 14 and extend from the ventilation holes 21 to the end of the second portion 14*b*. The cylindrical housing 14 also includes a plurality of air inlet slots (not shown) formed through the outer wall of the first portion 14*a*.

The ventilation control sleeve 15 is rotatably secured within the housing 14 by a locking pin 23 extending through the wall of the housing 14 and locating in a slot 24 formed through a portion of the circumference of the ventilation control sleeve 15. The ventilation control sleeve 15 is thereby able to rotate over a range of movement determined by the length of the slot 24. The slot 24 includes detents 24*a* to define stable rotational positions of the ventilation control sleeve 15.

A hollow cylindrical connector 25 is secured around the second portion 14*b* of the cylindrical housing 14 with an o-ring seal 26 disposed between the connector 25 and outside of the annular wall 16 of the cylindrical housing 14. The connector 25 is secured in place by a pair of retaining pins 27 which locate in a peripheral groove 28 in the second portion 14*b* of the cylindrical housing 14.

Figure 9A:
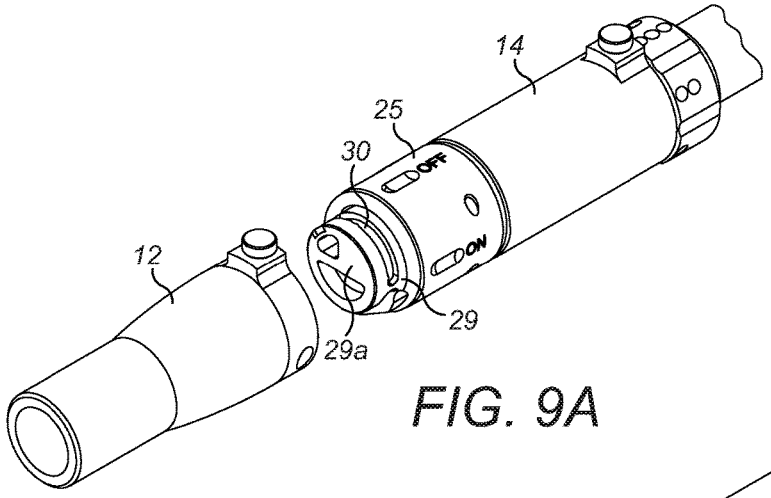
FIG. 9A shows a perspective view of the inhalation device of FIGS. 1 and 2, showing the mouthpiece prior to being secured onto the connector.
Figure 9B:
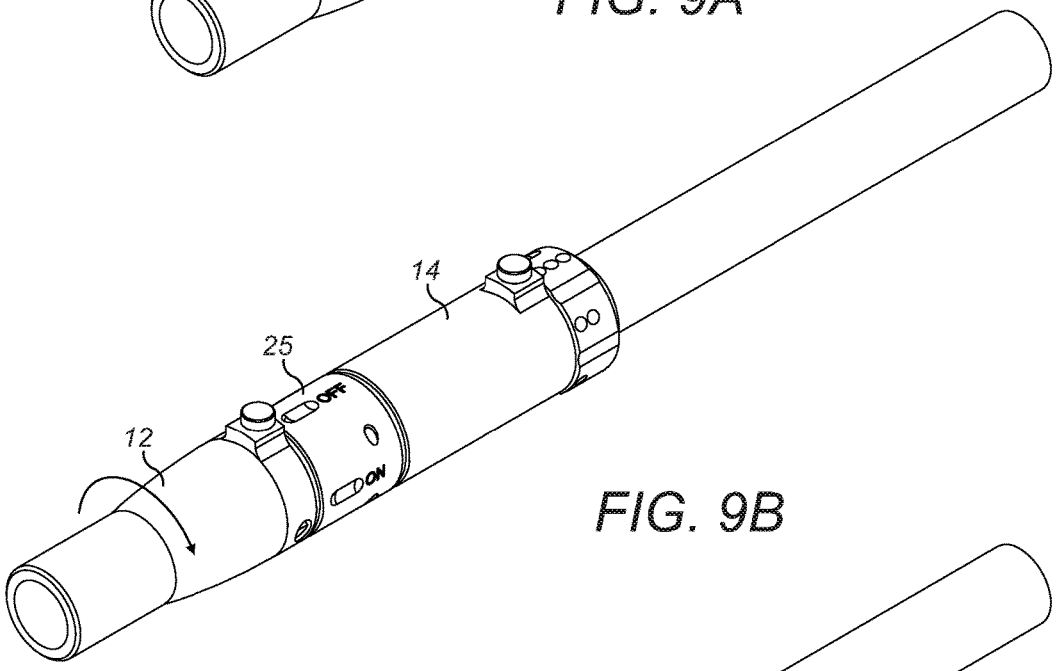
FIGS. 9B and 9C show perspective views of the mouthpiece in the 'flavour off' and 'flavour on' positions, respectively.
Figure 9C:
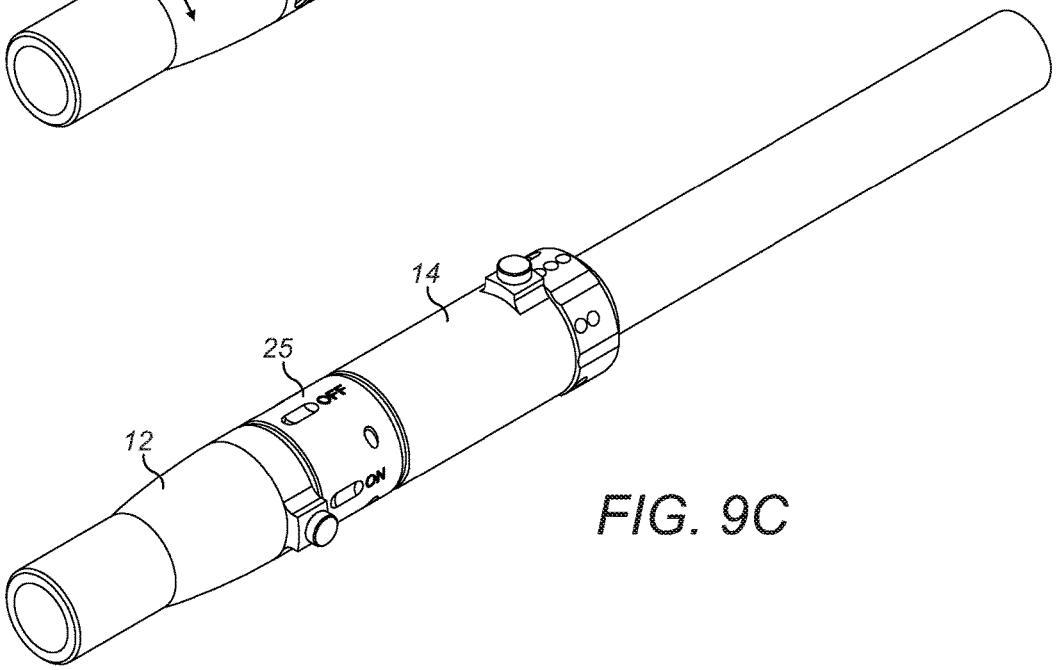
Figure 10A:
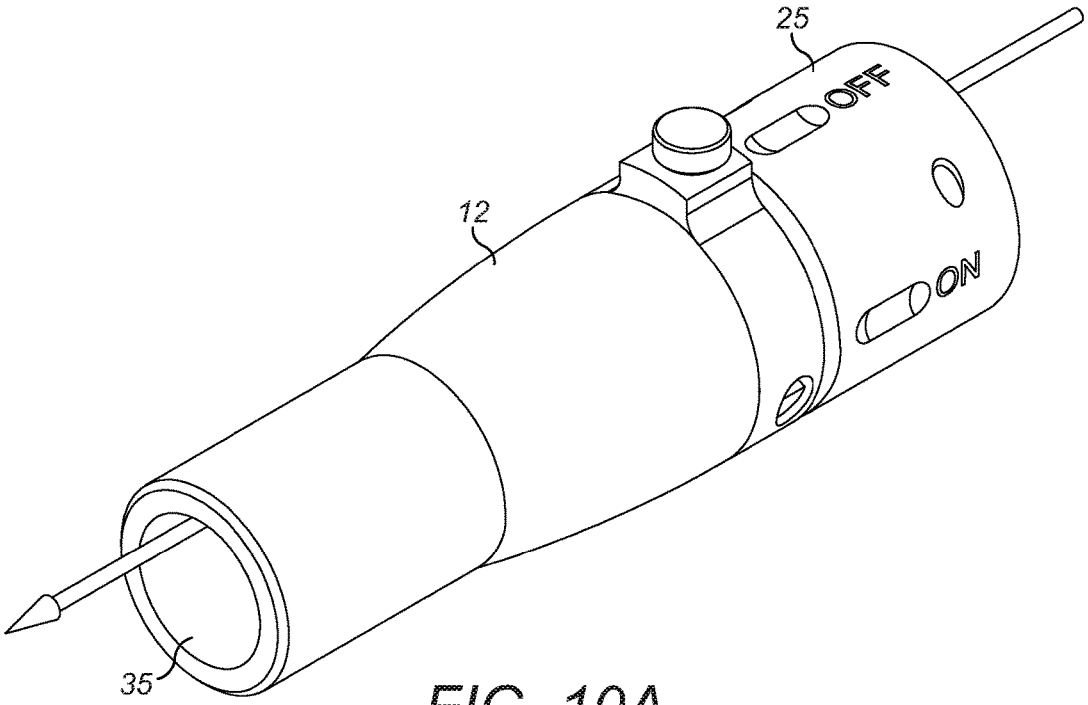
FIGS. 10A and 10B show perspective and end views of the inhalation device of FIGS. 1 and 2 with the mouthpiece in the 'flavour off' position.
Figure 10B:
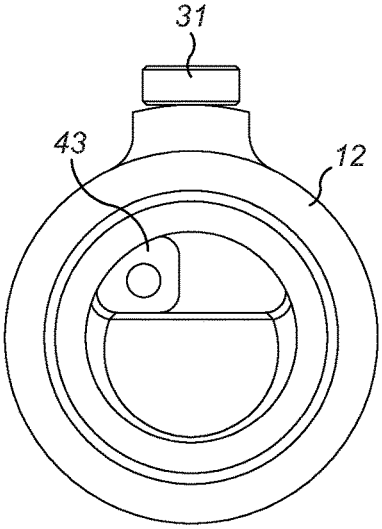
Figure 11A:
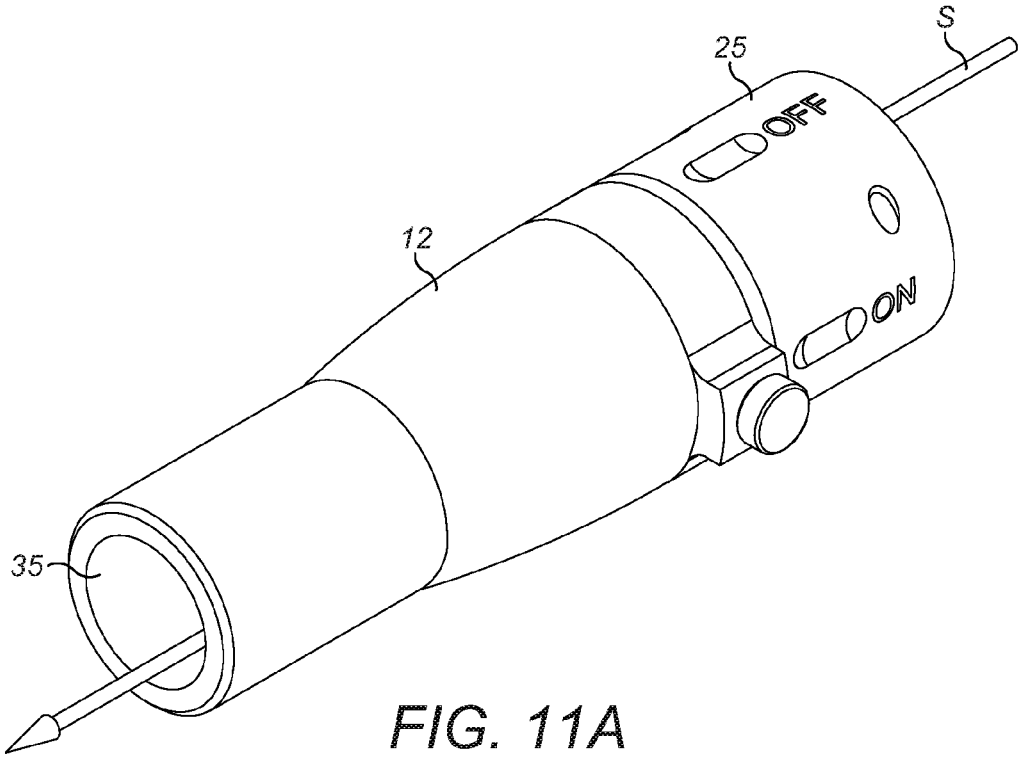
FIGS. 11A and 11B show perspective and end views of the inhalation device of FIGS. 1 and 2 with the mouthpiece in the 'flavour on' position.
Figure 11B:
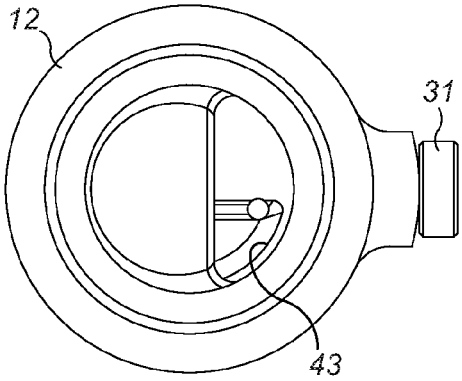
Figure 12:
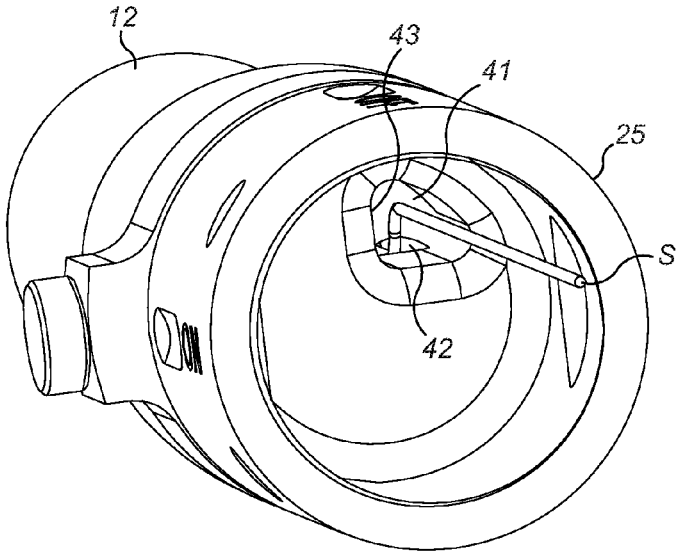
FIG. 12 shows a rear perspective view of the connector and mouthpiece in the 'flavour on' position illustrating the flow path therethrough.
Figure 13:
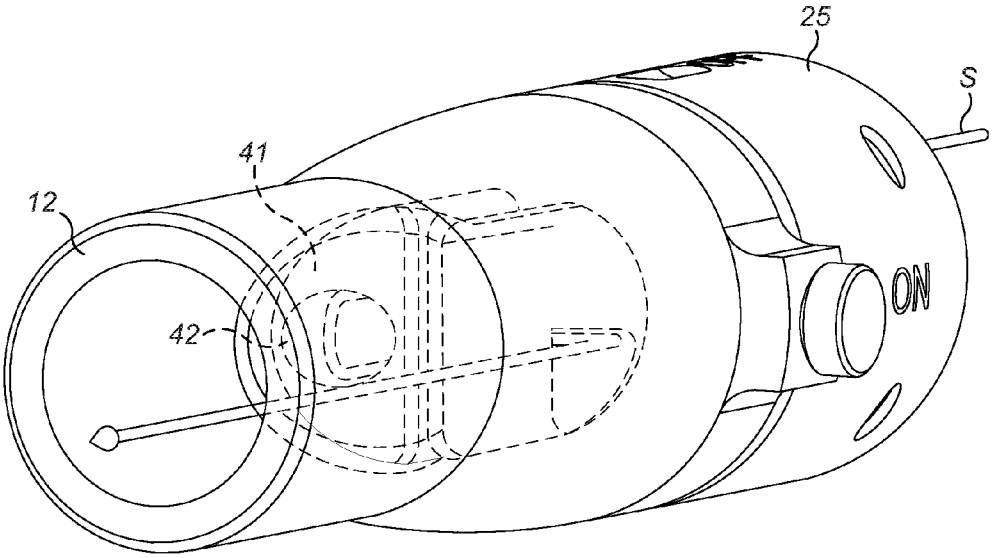
FIG. 13 shows a front perspective view of the connector and mouthpiece in the 'flavour on' position illustrating the flow path therethrough, with the mouthpiece shown as transparent for ease of illustration.
Figure 14:
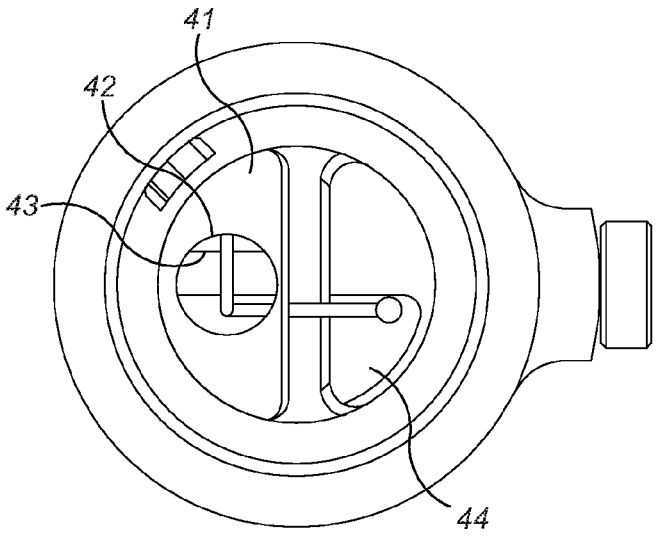
FIG. 14 shows front view of the connector and mouthpiece in the 'flavour on' position illustrating the flow path therethrough, with the mouthpiece shown as transparent for ease of illustration.
Figure 15:
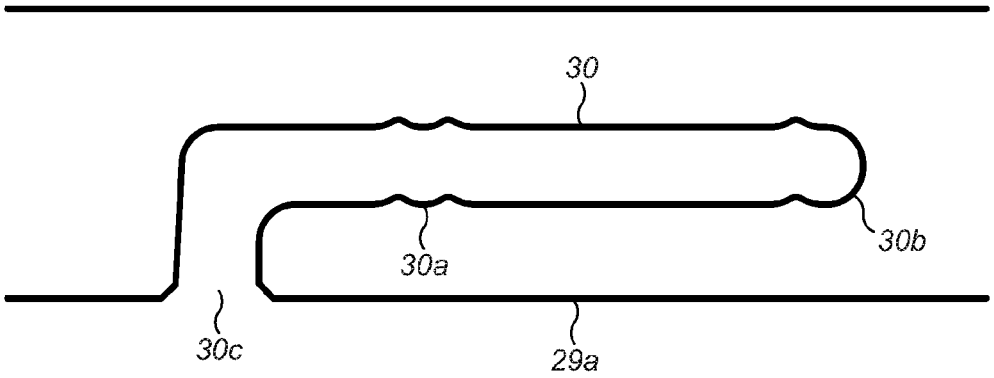
FIG. 15 shows a schematic two-dimensional view of the cam groove of the connector of the inhalation device of FIG. 1.

The end of the connector 25 remote from the cylindrical housing 14 includes a projecting portion 29 of reduced diameter with a cam groove 30 formed around a section of the perimeter surface thereof. The mouthpiece 12 is connected to the connector 25 around the projecting portion 29 by a cam pin 31 extending through the mouthpiece wall and locating in the cam-groove 30, and an assembly pin 32 extending through the mouthpiece wall and locating in a channel 33 on the projecting portion 29 separate to the cam groove 30. An o-ring 34 may optionally be disposed between the mouthpiece 12 and connector 25 to form an airtight seal therebetween, although this is not essential and is omitted from FIGS. 3-14. The mouthpiece 12 is rotatable relative to the connector 25, as shown in FIGS. 9B and 9C, between flavour "OFF" and "ON" positions. The extent of rotation is defined by the length of the cam groove 30 in which the cam pin 31 travels as the mouthpiece 12 is rotated. The cam groove 30 is shown schematically in FIG. 15 and comprises an "OFF" detent 30*a* and an "ON" detent 30*b* which provide stable positions of the mouthpiece 12 relative to the connector 25 in the respective flavour ON/OFF positions. Each detent 30*a*, 30*b* is spaced slightly further from an end face 29*a* of the projecting portion 29 than the remainder of the cam groove 30 so that the mouthpiece 12 is pulled tighter against the connector 25 when the cam pin 31 is located in the detents 30*a*, 30*b* than when the cam pin 31 is located in the rest of the cam groove 30 when rotating between ON/OFF positions. This promotes achieving an improved secure seal between the mouthpiece 12 and connector 25 in the ON/OFF positions. The detents 30*a*, 30*b* also provide a tactile feedback to the user that the mouthpiece 12 is correctly located in the desired position. The cam groove 30 also includes an entrance portion 30*c* which extends to the adjacent end face 29*a* of the projecting portion 29 of the connector 25 to receive the end of the cam pin 31 when the mouthpiece 12 is attached to and removed from the connector 25.

The connector 25 is hollow to allow smoke to pass therethrough, and a path through the connector 25 exits through the end face 29*a* at a quadrant opening 43 at an upper portion thereof. A lower portion of the end face 29*a* includes a recess 44 which semi-circular and separate from the path through the connector 25. The recess 44 is a blind cavity, that is, it is closed-bottomed and open only at the end face 29*a*.

Figure 3:
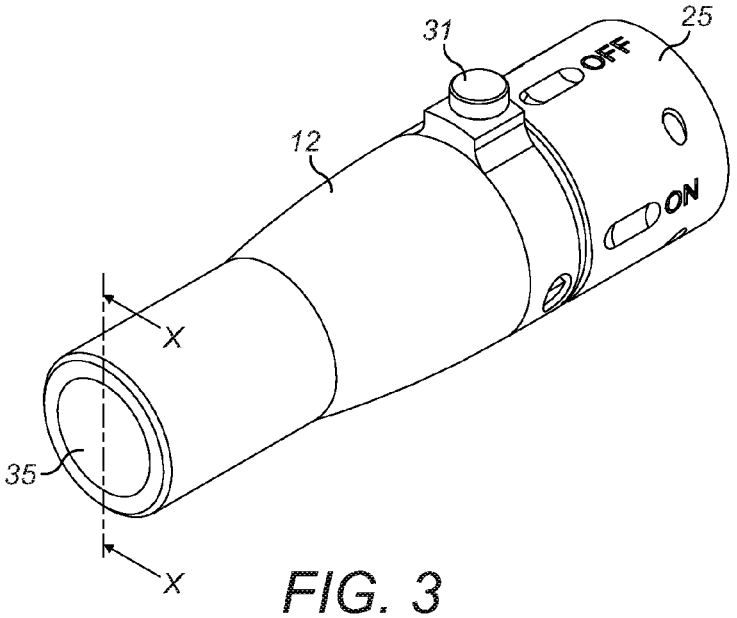
FIG. 3 shows a perspective view of the mouthpiece and connector of the inhalation device of FIG. 1.
Figure 4:
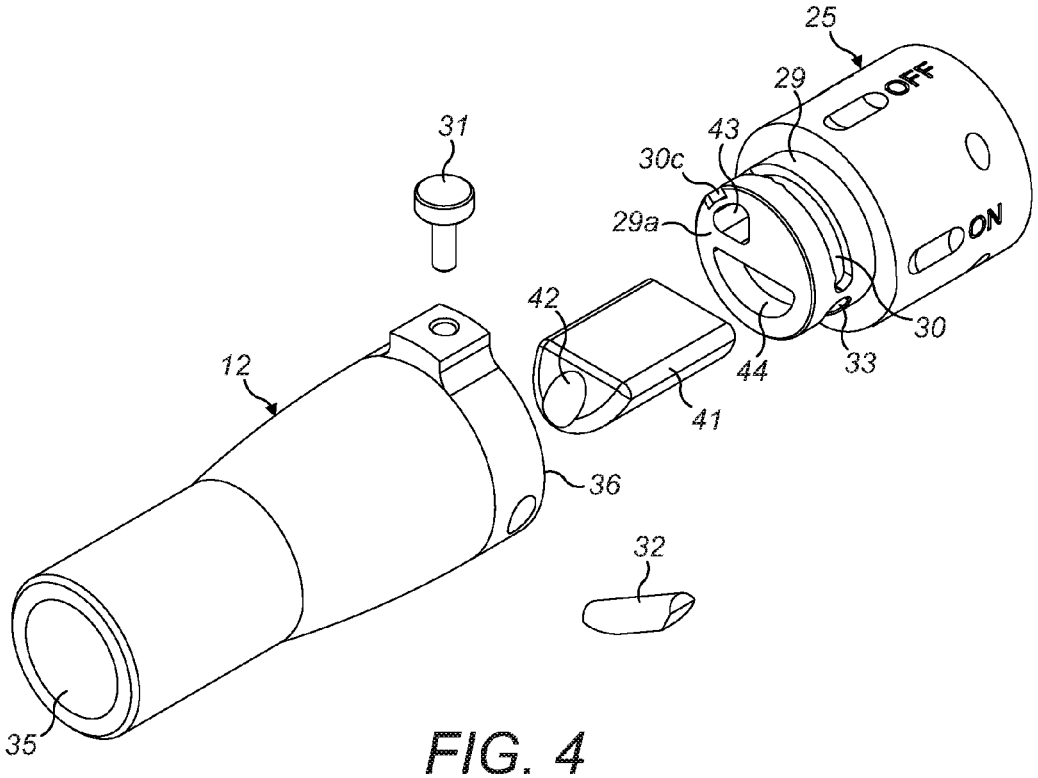
FIG. 4 shows an exploded perspective view of the mouthpiece and connector of FIG. 3.
Figure 5:
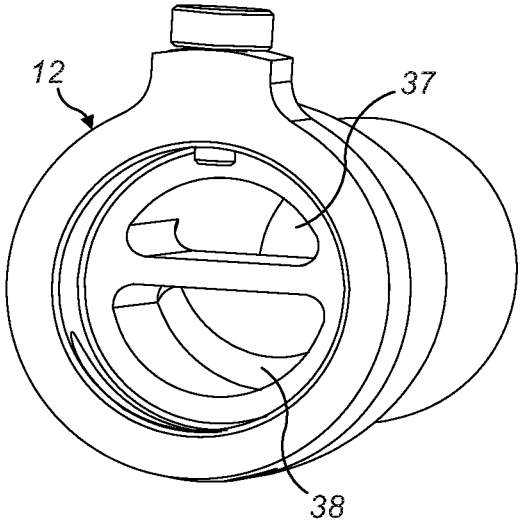
FIG. 5 shows a rear perspective view of the mouthpiece of FIGS. 1-4.
Figure 6:
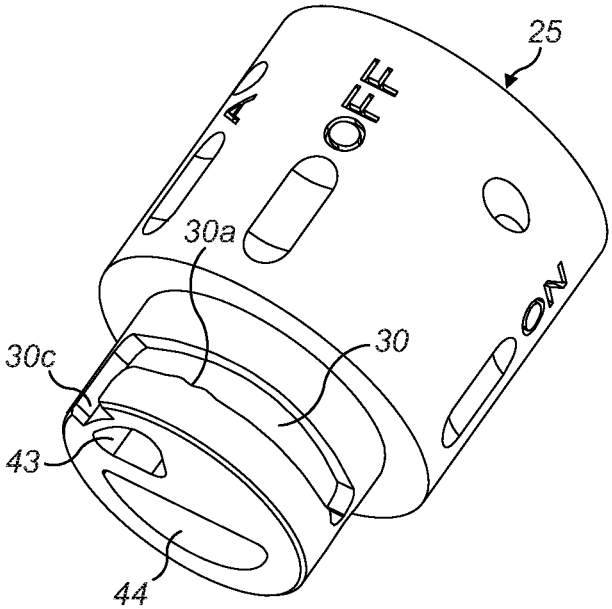
FIG. 6 shows a front perspective view of a connector of the smoking device of FIGS. 1 and 2.
Figure 7:
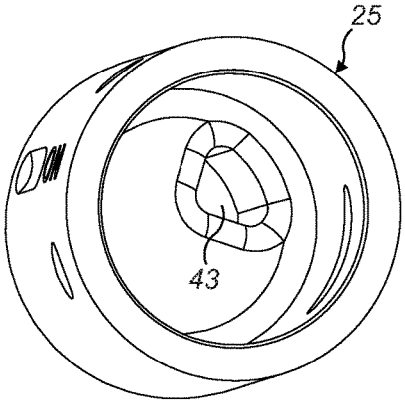
FIG. 7 shows a rear perspective view of the connector of FIG. 6.
Figure 8:
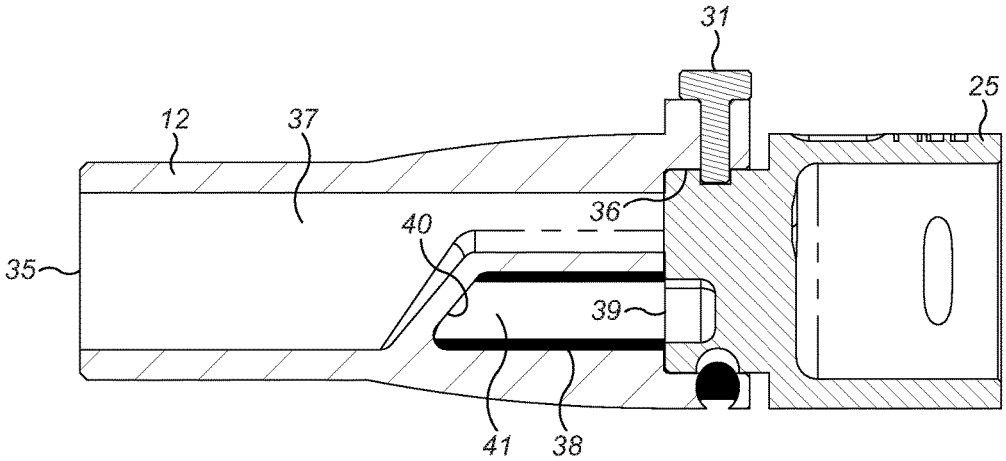
FIG. 8 shows a cross-sectional view along the line X-X of the mouthpiece and connector of FIG. 3.

The mouthpiece 12 is shown in more detail in FIGS. 3-5, and includes a first open end 35 through which smoke is drawn by a user, and a second open end 36 which receives the projecting portion 29 of the connector 25. A passage 37 communicates the first and second open ends 35, 36. The passage 37 narrows from the first open end 35 to the second open end 36, such that the opening of the passage 37 at the second open end 36 is semi-circular and is disposed at the upper portion of the mouthpiece 12 only. The second open end 36 of the mouthpiece includes a recess 38 which is separate from the passage 37. The recess 38 is a blind cavity, that is, it includes an opening 39 at one end only, the opposite end being closed by an end wall 40.

A body of organoleptic material 41 is disposed in the recess 38 to impart a flavour to smoke as the smoke stream passes over the body 41. The body 41 includes a cavity 42 extending therethrough. The body 41 may comprise a material matrix containing a flavourant, for example, cellulose acetate impregnated with menthol flavourant. Alternatively, the body 41 may comprise a different solid material impregnated with flavourant or other organoleptic compound. The flavourant imparted may be by means of particulate material entrained in the smoke stream, or in gaseous form evaporated or otherwise leached from the organoleptic material 41.

In use, the mouthpiece 12 is pushed fully onto the connector 25 (see FIG. 9A) and the cam pin 31 enters the entrance portion 30*c* of the cam groove 30. The mouthpiece 12 is then rotated until the cam pin locates in the OFF detent 30*a* (see FIG. 9B). When the smoking device 10 is in use, a user has the option of whether or not flavourant is added to the smoke stream passing through the device 10. When the mouthpiece 12 is in the OFF position, the quadrant opening 43 in the connector 25 is aligned with the semi-circular second opening 36 in the mouthpiece 12 (see FIGS. 10A and 10B) to define a first smoke flow path through the smoking device 10 in which the smoke steam passes straight from the connector 25 through the passage 37 in the mouthpiece 12 and out of the first open end 35 without encountering the body of flavourant material 41.

If a user wishes to experience a flavoured smoke, the mouthpiece is rotated to the ON position (see FIG. 9C). The quadrant opening 43 in the connector 25 then partially overlaps the cavity 42 in the body of flavourant 41 (see FIG. 12). In addition, the semi-circular recess 44 in the connector 25 also partially overlaps the cavity 42 in the body of flavourant material 41 (see FIG. 14), and partially overlaps the semi-circular second opening 36 in the mouthpiece 12 (see FIGS. 11 and 14). When a user draws on the mouthpiece 12, smoke is drawn through a second smoke flow path through the smoking device 10, illustrated by arrow S in FIGS. 9-11, which travels through the quadrant opening 43 into the cavity 42 in the organoleptic body 41, within which the smoke swirls and picks up flavourant as it sweeps over the surface of the body 41. The smoke stream S exits the cavity 42 into the semi-circular recess 44 in the connector 25 and passes from the semi-circular recess 44 into the second opening 36 in the mouthpiece 12, through the passage 37 and out of the mouthpiece through the first opening 35.

The organoleptic body 41 may provide desirable flavour delivery for smoking of a predetermined number of tobacco rods 13, after which it may be depleted and require replacement. This may be achieved by removing the mouthpiece 12 and organoleptic body 41 and replacement with a new mouthpiece 12 having a fresh organoleptic body 41 therein. Alternatively, the organoleptic body 41 may be removable from the mouthpiece 12 and the user may replace the depleted organoleptic body 41 with a fresh one into the same mouthpiece 12. In the latter embodiment, the organoleptic body 41 may be provided within a sleeve or other outer casing (not shown) to facilitate removal from and replacement into the mouthpiece 12. In the former embodiment, the organoleptic body 41 may be formed with, or set into, the recess 38 in the mouthpiece as a manufacturing step, and the replacement mouthpiece 12 may be provided with a sealing cover over the opening 39 of the recess 38 to prevent escape of any organoleptic material before first use, such as any volatile and/or aromatic compounds. Such a cover could comprise a foil adhered over the opening 39 which a user would remove prior to connecting the new mouthpiece 12 to the connector 25. In either case, the replaceable component of either the organoleptic body 41 or mouthpiece 12 could be provided in multiple refill packs supplied separately to the controller body 11 of the smoking device 10, for example, multi-blister packs in which each replacement component is sealed within its own pocket.

The detents 30*a*, 30*b* in the cam groove 30 are configured such that there is an interference fit between the mouthpiece 12 and connector 25 when the mouthpiece 12 is in the ON and OFF positions. When in the OFF position, this promotes an effective sealing between the recess 38 in the mouthpiece and the end face 29*a* of the projecting portion 29 of the connector 25, which ensures that none of the organoleptic compounds escape, such as volatile and/or aromatic compounds.

The ventilation control sleeve 15 can be adjusted to control an amount of ambient air that is drawn into the smoking device 10 to mix with the smoke stream as a user draws on the mouthpiece 12. In a first position of the ventilation control sleeve 15, the control ring 17 covers the ventilation holes 21 in the annular wall 16 of the housing 14, and air that has entered the first portion 14*a* of the housing 14 through the air inlet slots is prevented from passing through the annular wall 16 and mixing with the smoke stream. The spring 20 biasing the control ring 17 into contact with the annular wall 16 ensures the seal is secure.

Rotation of the ventilation control sleeve 15 to a second position moves the plate 18 and control ring 17 such that the section of reduced thickness 19 aligns with one of the ventilation holes 21 to provide a gap between the ventilation hole 21 and the control ring 17. Air that has entered the first portion 14*a* of the housing 14 through the air inlet slots is then able to pass through the annular wall 16 via the one exposed ventilation hole 21, pass along the corresponding ventilation channel 22, and mix with the smoke stream within the connector 25 as a mixing chamber, to provide a first degree of smoke ventilation and dilution.

Further rotation of the ventilation control sleeve 15 to a third position moves the plate 18 and control ring 17 such that the section of reduced thickness 19 aligns with more of the ventilation holes 21 to provide a gap between the additional ventilation holes 21 and the control ring 17. Air from the first portion 14*a* of the housing 14 is then able to pass through the annular wall 16 via the plurality of exposed ventilation holes 21, pass along the corresponding ventilation channels 22, and mix with the smoke stream within the connector 25, providing an increased level of smoke ventilation and dilution.

It will be appreciated that in the smoking device 10 described above, the degree of external ventilation air that is introduced into the smoke stream is variable, thereby varying sensory intensity of the smoking experience. In all cases, the smoke stream, with or without additional ventilation air, passes over the organoleptic body 41 when smoke flavouring is selected by a user. It will also be appreciated that control of the ventilation is independent to the control of additional flavour from the organoleptic body 41. This ensures a greater variety of user control over the smoking experience achievable from the smoking apparatus 10.

Figure 16:
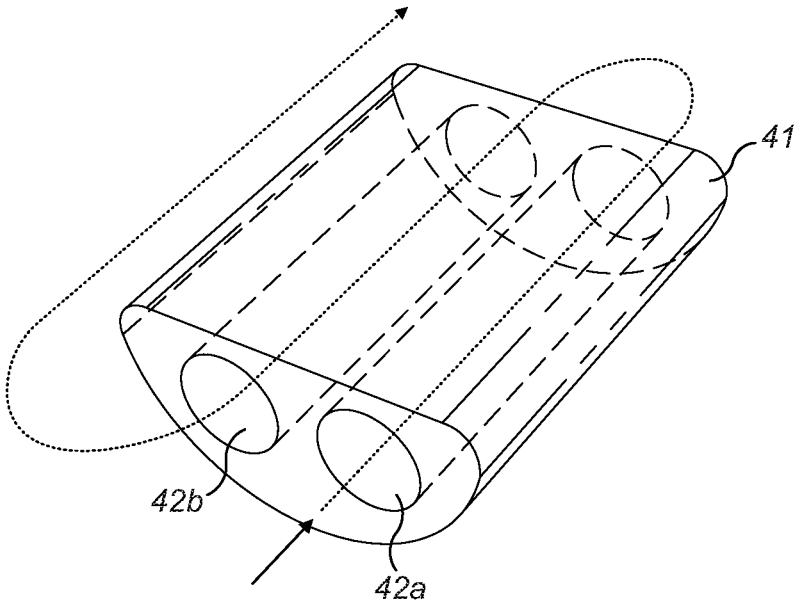
FIG. 16 shows a first alternative configuration of organoleptic body of the mouthpiece.

FIG. 16 shows a first alternative configuration of organoleptic body 41 useable with the mouthpiece 12 which comprises two passages 42*a*, 42*b* which are disposed side by side and which are open to a common space at the rear 45 of the organoleptic body 41. This common space may be formed within the organoleptic body 41 (i.e. the two cavities are connected) or the body 41 may not extend to the end wall 40 of the recess 38 so the common space is a rear area of the recess 38. In use with the mouthpiece 12 as described above when in the "ON" position, the smoke stream S passes from the quadrant opening 43 into the first cavity 42*a* in the flavourant body 41, through the common space and out through the second cavity 42*b* into the semi-circular recess 44 in the connector 25 to the second opening 36 in the mouthpiece 12 and out thereof as described above. Here, the smoke picks up flavourant as it sweeps over the inside surfaces of the first and second cavities 42*a*, 42*b*.

Figure 17:
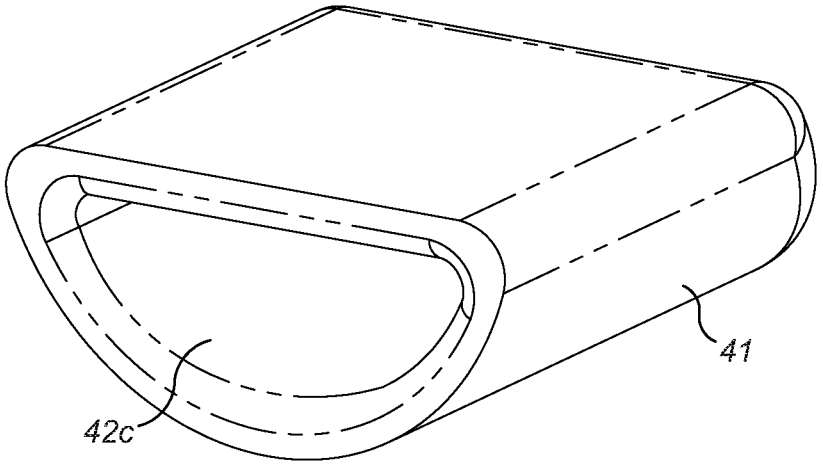
FIG. 17 shows a second alternative configuration of organoleptic body of the mouthpiece.

FIG. 17 shows a second alternative configuration of organoleptic body 41 useable with the mouthpiece 12, which comprises a single cavity 42*c* but which is larger than the cavity 42 of the first organoleptic body 41 described previously. The mouthpiece 12 including the second alternative configuration of organoleptic body would function in the same way as the first-described configuration, although the increased internal surface area of the cavity 42*c* may provide increased flavourant delivery.

The embodiment of the mouthpiece 12 described above includes a cam pin 31 and assembly pin 32 to secure the mouthpiece 12 to the connector 25. However, an alternative embodiment may include inwardly projecting lugs on the inside wall of the mouthpiece in place of the cam and assembly pins. Such lugs could be moulded integrally with the mouthpiece 12, and the cam groove 30 and channel 33 in the connector 25 may both include a section extending to the end face 29*a* of the projecting portion 29. The mouthpiece could then be connected to and disconnected from the connector 25 by a bayonet-fitting type connection and so be simpler to operate by users.

Referring now to FIGS. 18-21, a flavourant delivery and control mechanism in of a smoking device (not shown) of a second embodiment is shown. Such a mechanism can be incorporated into the connector 25 of the previously-described embodiment, and coupled to a mouthpiece of a different configuration, not having recess 38 but simply being a tubular element. The remaining features of the smoking device 10 of the first embodiment remain unchanged and so detailed description will not be repeated.

The control mechanism 111 comprises a casing 112 having an inlet 113 in communication with an outlet 114 via a central chamber 115. The outlet 114 includes a plurality of blocking portions 116 arranged around the central axis of the outlet 114 which define a plurality of passages 117 therebetween. In the embodiment shown, there are three blocking portions 116 defining three passages 117, each shaped as a sector of the circular outlet. However, this arrangement is exemplary only and other numbers of passages/blocking portions may alternatively be provided.

Figure 18:
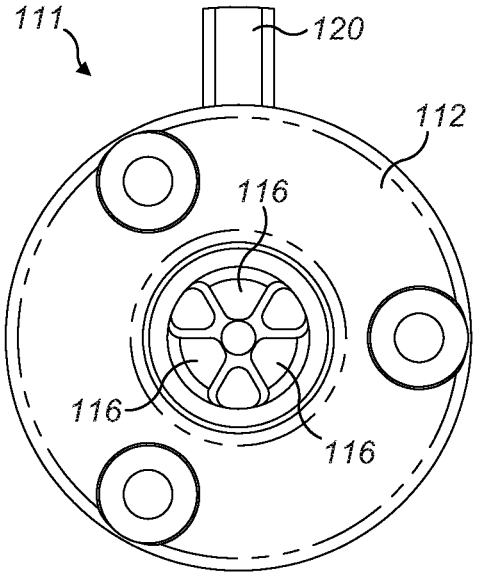
FIG. 18 shows an end view of a control mechanism of an inhalation device of a second embodiment in a 'flavour off' position.
Figure 19:
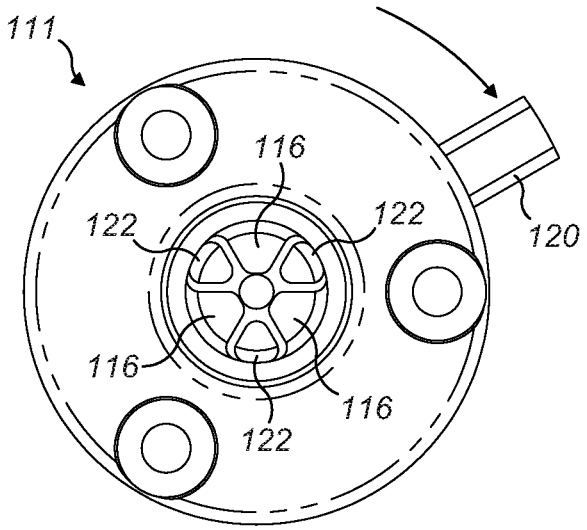
FIG. 19 shows an end view of the control mechanism of FIG. 18 in a 'flavour on' position.
Figure 20:
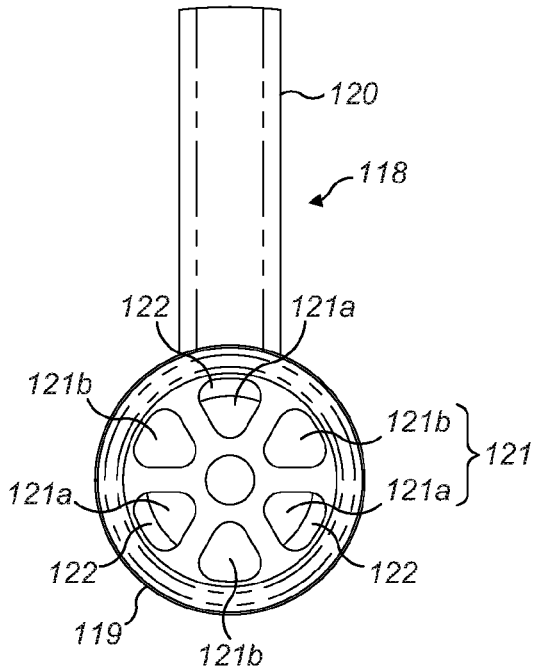
FIG. 20 shows an end view of a component of the control mechanism of FIGS. 18 and 19.
Figure 21:
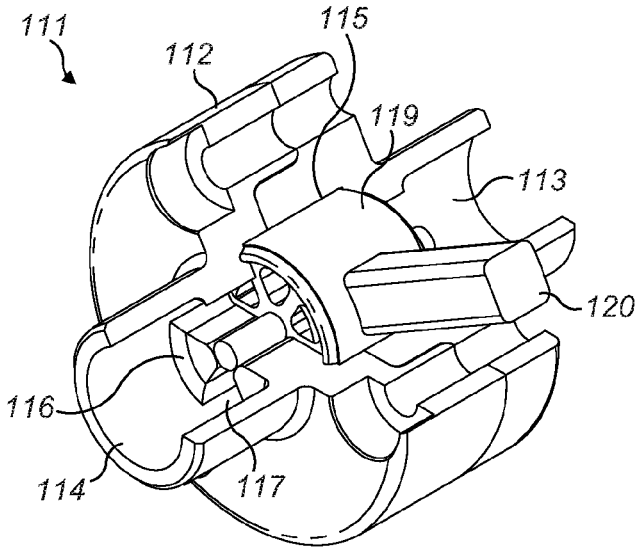
FIG. 21 shows a partial cut-away perspective view of the control mechanism of FIG. 19.

An actuator 118 is disposed in the casing 112 and has a cylindrical barrel portion 119 with a lever 120 extending therefrom. The lever extends through a slot (not shown) in the casing 112. The actuator 118 is rotatable within the casing 112 by movement of the lever 120 along the slot. The barrel 119 includes a plurality of sector-shaped passages 121 shaped corresponding to the blocking portions 116 and passages 117 in the outlet 114. The actuator 118 shown in FIGS. 18-21 includes six passages 121 although alternative embodiments may have more or less, depending on the configuration of the outlet 114. Alternating passages 121*a* of the actuator 118 include an organoleptic material 122 on an inside surface thereof, the remaining passages 121*b* do not have any such material. When the lever 120 is in an "OFF" position as shown in FIG. 18, the passages 121*a* with the organoleptic material coating are aligned with the blocking portions 116 and the passages 121*b* without the organoleptic material coating are aligned with the passages 117 in the outlet 114. Therefore, the only fluid path through the control mechanism from the inlet 113 to the outlet 114 is through the passages 121*b* without the organoleptic material coating. Conversely, when the lever 120 is in an "ON" position as shown in FIG. 19, the passages 121*a* with the organoleptic material coating are aligned with the passages 117 in the outlet 114 and the passages 121*b* without the organoleptic material coating are aligned with the blocking portions 116. Therefore, in the ON position, the only fluid path through the control mechanism from the inlet 113 to the outlet 114 is through the passages 121*a* with the organoleptic material coating.

In use, a user of the smoking device no can select between unflavoured smoke or flavoured smoke by moving the lever 120 between the OFF and ON positions. In the OFF position, the smoke stream passes through the passages 121*b* of the barrel 119 without encountering the organoleptic material. However, in the ON position, the smoke stream passes through the passages 121*a* of the barrel 119 which include the organoleptic material coating and so a flavourant is picked up by the smoke steam as it passes over the organoleptic material 122.

The twist flavour control mechanism in of the second embodiment may be replaced after a predetermined number of smokes of tobacco rods 13 or when the flavour delivery reduces. Replacement may occur by replacement of the connector 25 on the housing 14. In an alternative configuration of the smoking device, the control mechanism 111 may be provided on the mouthpiece instead of the connector, and so replacement of the flavour control mechanism may be effected by replacement of the mouthpiece as described previously. In such an alternative embodiment, the connector would not need to have the flow path shaped as a quadrant 43 as described above, and could simply comprise a central circular aperture.

Figure 22:
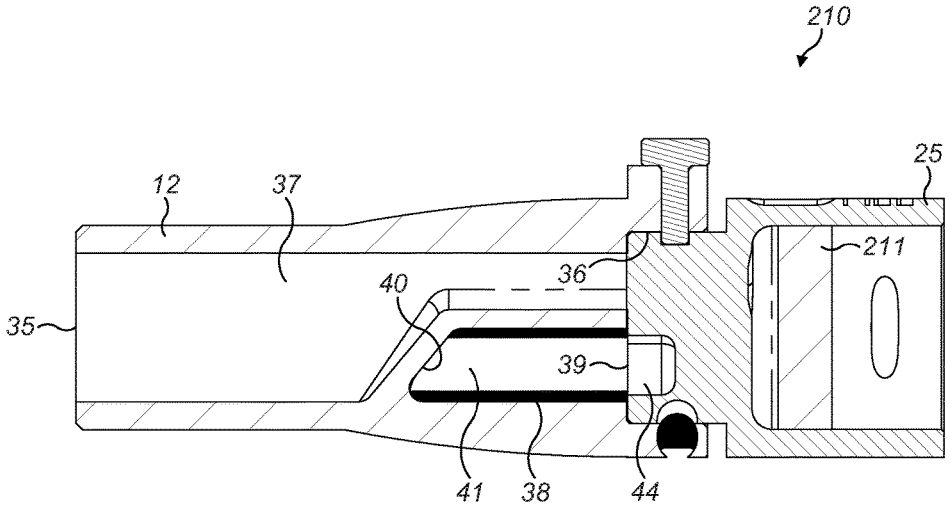
FIG. 22 shows a cross-sectional view of a mouthpiece and connector similar to that shown in FIG. 8, but of a third embodiment.
Figure 23:
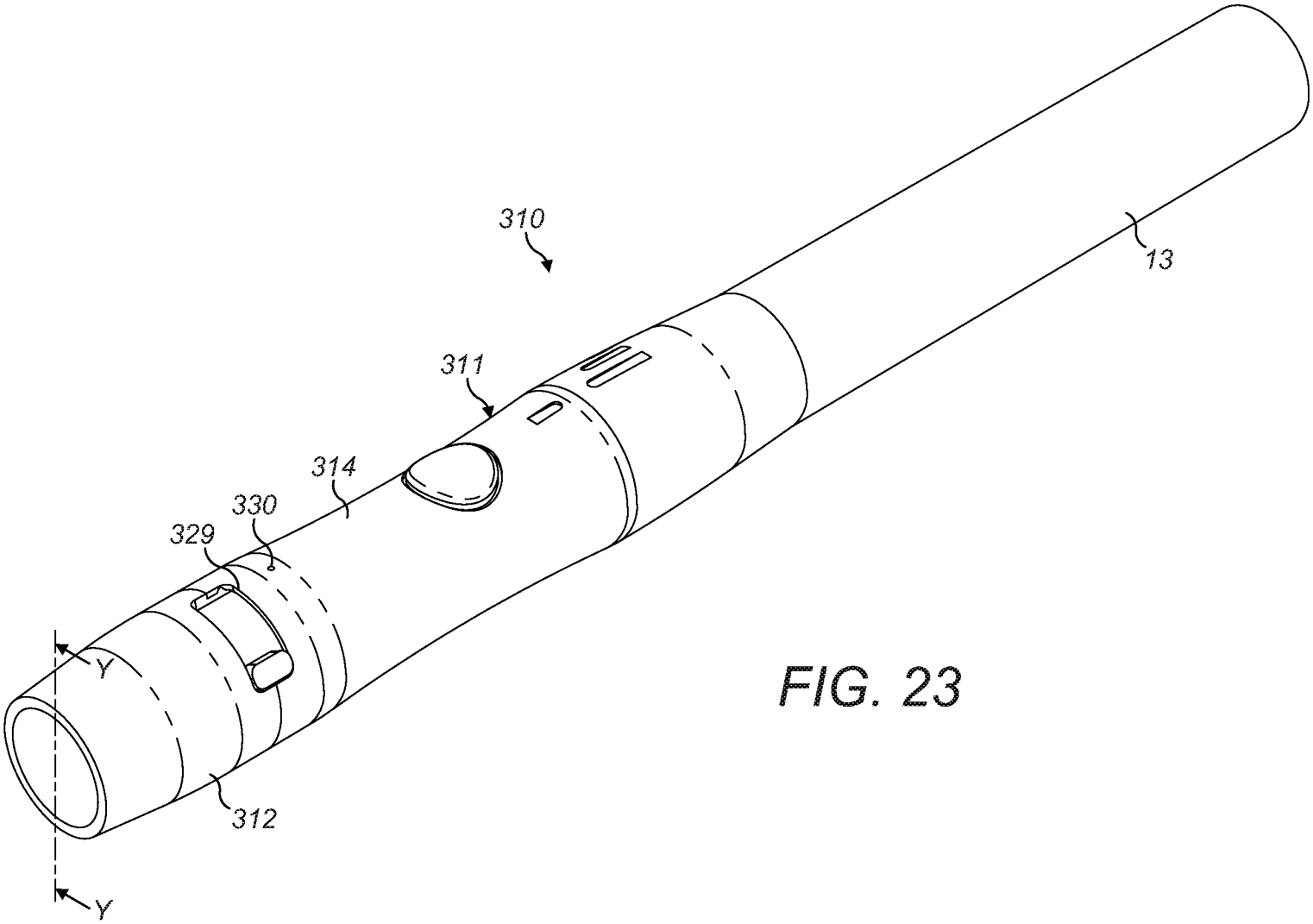
FIG. 23 shows a perspective view of an inhalation device of a fourth embodiment.

A mouthpiece 12 and connector 25 of a smoking device 210 of a third embodiment is shown in FIG. 22 and is similar to the mouthpiece 12 and smoking device 10 of the first embodiment, and like features retain the same reference numerals. One difference between the first and third embodiments is that the connector 25 of the third embodiment includes an additional filter element 211 in the form of a pad containing carbon-based material disposed in the main body of the connector 25 between the entrance to the quadrant opening 43 and the end of the second portion 14*b* of the housing 14. The smoking device 210 of the third embodiment is used in the same manner as the first embodiment described above, although the smoke stream passes through the filter element 211 as it travels from the housing 14 into the mouthpiece 12. The carbon material in the filter element 211 filters out further constituents of the smoke stream before it reaches the mouthpiece 12. The technical benefit described above of the mouthpiece making an effective seal against the connector 25 when in the flavour OFF position is again important so that the filter element 211 and the organoleptic body 41 are sealed from each other, in order to prevent any of the organoleptic material or volatile/aromatic components therefrom being absorbed by the carbon and therefore effectively wasted, reducing the life of the organoleptic body and/or reducing the effectiveness of the carbon-based filter element 211.

FIGS. 23-26 show a smoking device 310 of a fourth embodiment comprising a controller body 311 configured to receive a combustible tobacco rod 13 as described previously. The controller body 311 comprises a housing 314 and a mouthpiece 312 attached to an end thereof opposite the tobacco rod 13 end. The housing 314 contains a holding tube 316 which is slidable within the housing 314 and is configured to receive the end of a tobacco rod 13. The holding tube 316 includes a pawl 317 which is receivable in an aperture 318 in the housing 314. A push button 319 is provided on the housing over the aperture 318 to push the pawl 317 out of engagement with the edge of the aperture 318 to allow the holding tube 316 to slide within the housing 314. A spring 320 is disposed within the housing against a first end of the holding tube 316 and biases the holding tube 316 in a direction out of the housing 314. The pawl 317 is configured to retain the holding tube 316 in a retracted position within the housing against the force of the spring 320.

Figure 24:
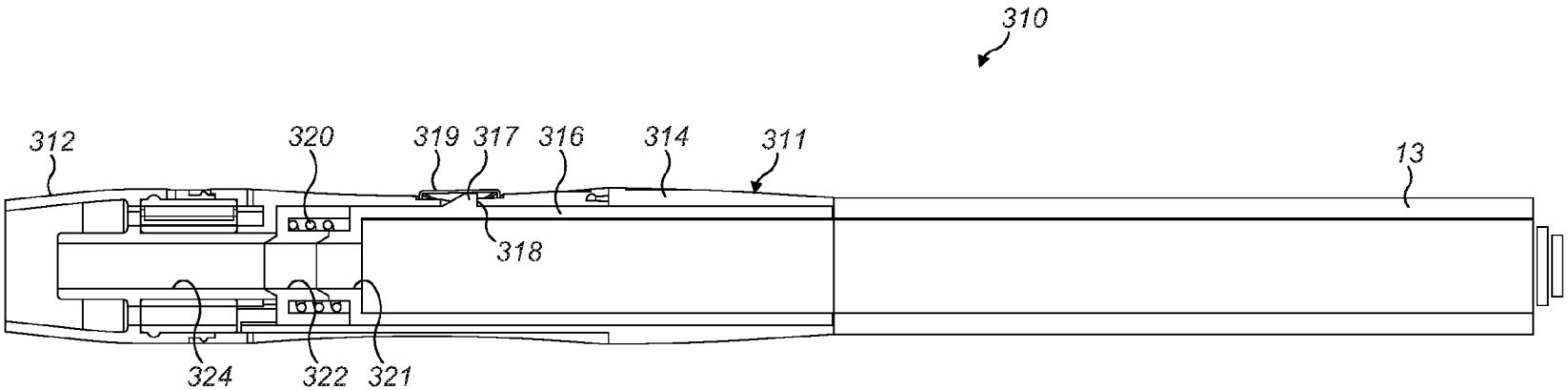
FIG. 24 shows a cross-sectional side view of the inhalation device of FIG. 23 along the line Y-Y.

A duct 321 extends from the first end of the holding tube 316 and couples to a duct 322 in the housing 314 when the holding tube is in the retracted position (see FIG. 24).

A flavour control cartridge 323 is provided within the mouthpiece 312 and the end of the housing 314, and comprises a central conduit 324 and a rotatable collar 325 around the outside of the conduit 324. The conduit 324 is fluidly coupled to the duct 322 in the housing 314 and thereby to the duct 321 in the holding tube 316. The collar 325 includes a plurality of passages 326 extending in an axial direction through the collar 325. A blocking plate 327 is provided around a portion of the outer perimeter of the conduit 324 and is configured to block the flow path through one of the passages 326 when it is aligned with the blocking plate 327.

An actuator button 328 projects from the outer surface of the collar 325 through a slot 329 in the side wall of the mouthpiece 312 such that the collar 325 can be rotated within the mouthpiece 312 between a first position and a second position by sliding the actuator button 328 along the slot 329. An outer wall of the mouthpiece 312 includes a ventilation hole 330 through which ambient air can pass into the area of the mouthpiece 312 behind the collar 325 of the flavour control cartridge 323 and around the outside of the conduit 324.

Figure 25:
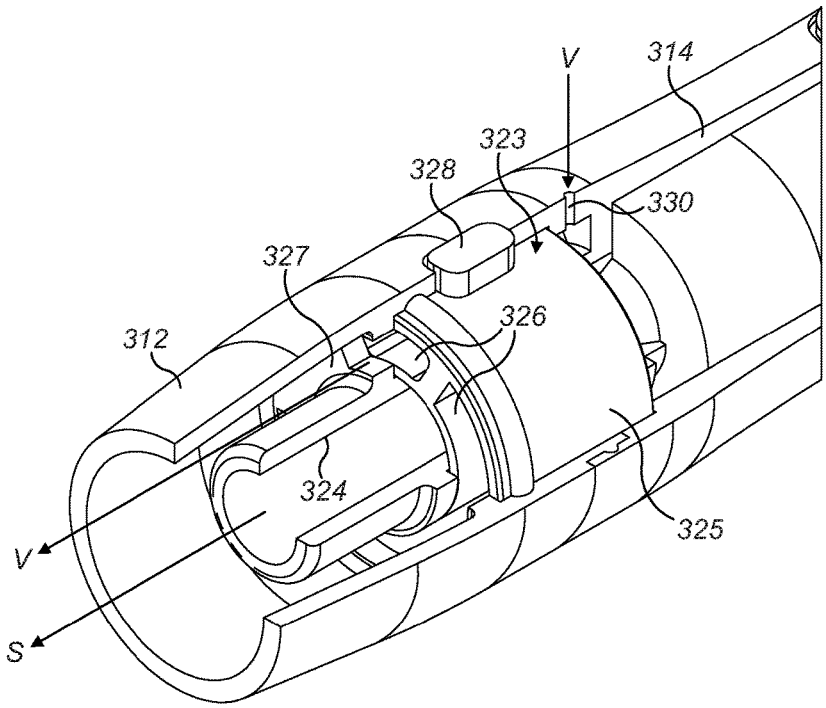
FIG. 25 shows a cut-away view of a portion of the inhalation device of FIG. 23 in a first position.
Figure 26:
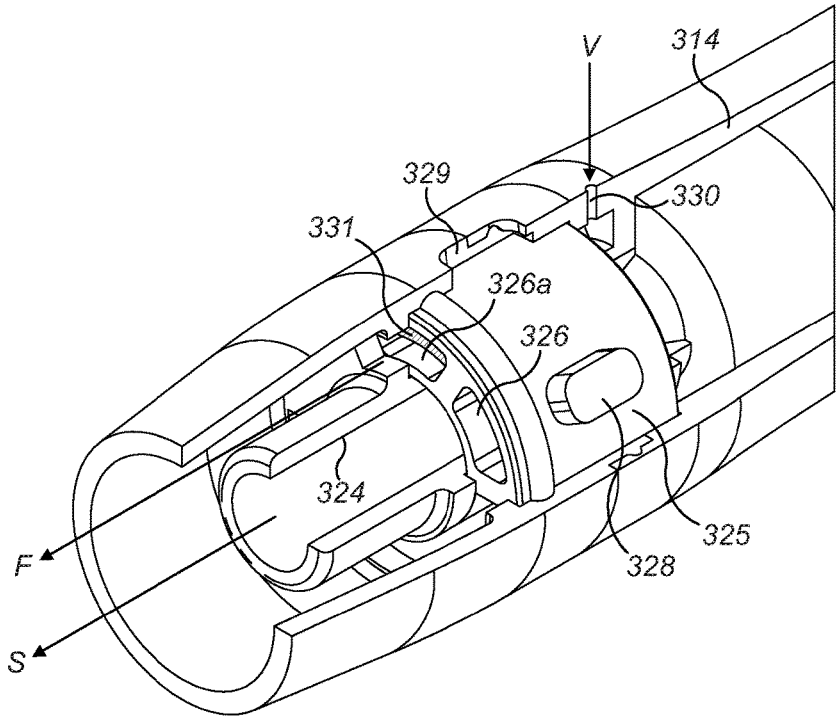
FIG. 26 shows a cut-away view of a portion of the inhalation device of FIG. 23 in a second position.

An inside wall of one of the passages 326*a* includes a coating of an organoleptic material 331, which may comprise flavourant compound, such that as air flows through the coated passage 326*a*, flavourant is imparted to the airflow as it sweeps over the organoleptic material 331. When the collar 325 is in the first position as shown in FIG. 25, the coated passage 326*a* with the organoleptic material 331 is located behind the blocking plate 327 and so airflow through the coated passage 326*a* is prevented. When the collar 325 is in the second position as shown in FIG. 26, the coated passage 326*a* is rotated away from the blocking plate 327 such that air may flow therethrough.

If a user uses the smoking device 310 to smoke a tobacco rod 13 with the collar 325 in the first position, when the user draws on the mouthpiece 312, smoke is drawn through the tobacco rod 13, through the duct 321 in the holding tube 316, through the duct 322 in the housing 314 and through the conduit 324 in the mouthpiece 312, as shown by arrow S in FIG. 25. Simultaneously, ambient air is drawn through the ventilation hole 330, through the passages 326 in the collar 325 and into the mouthpiece 312, as shown by arrow V in FIG. 25, where the ventilation air V mixes with the smoke stream S. As the coated passage 326*a* is aligned with the blocking plate 327, the ventilation airflow cannot pass therethrough and so no flavourant is imparted to the ventilation airflow. If, however, the collar 325 is moved to the second position, smoke is drawn into the mouthpiece 312 as described above, shown by arrow S in FIG. 26, but the ambient air drawn through the ventilation hole 330 is able to pass through the coated passage 326*a* since it has moved out of alignment with the blocking plate 327, and so the ventilation airflow V passes through the coated passage 326*a* and flavourant is imparted to the ventilation airflow as it sweeps over the organoleptic material 331, shown by arrow F in FIG. 26. Thereafter, the flavoured airflow F and smoke stream S mix in the mouthpiece 312.

The configuration of the smoking device 310 of the fourth embodiment is such that the smoke stream S and the ventilation airflow V, F are kept separate and only mix in the final portion of the mouthpiece 312 just prior to delivery to the mouth. Furthermore, it is only the ventilation air V, which bypasses the smoke stream S, that encounters the organoleptic material 331, and so the various control surfaces of the ventilation and flavour control mechanism do not encounter the smoke stream S. This arrangement prevents build up of deposits from the smoke stream on the ventilation/flavour control surfaces, with the inherent hygiene benefits and improved mechanism longevity.

Although the smoking device 310 of the fourth embodiment is described as having one coated passage 326*a* in the collar 325, variations to this configuration are intended, and the collar 325 may comprise a plurality of coated passages 326*a*. In such a variation, the flavour control cartridge 323 would include a corresponding plurality of blocking plates 327 such that all coated passages 326*a* are blocked in the collar's first position and are exposed for ventilation airflow to pass therethrough in the collar's second position. Such a configuration may be similar to the flavour control mechanism in of the second embodiment shown in FIGS. 18-21.

It is intended in a further alternative variation of the smoking device 310 of the fourth embodiment that the a mechanism may be included to selectively open or close the ventilation hole 330 such that a user may select no ventilation air to be mixed with the smoke stream, as well as selecting whether the ventilation air is flavoured or not.

Figure 27:
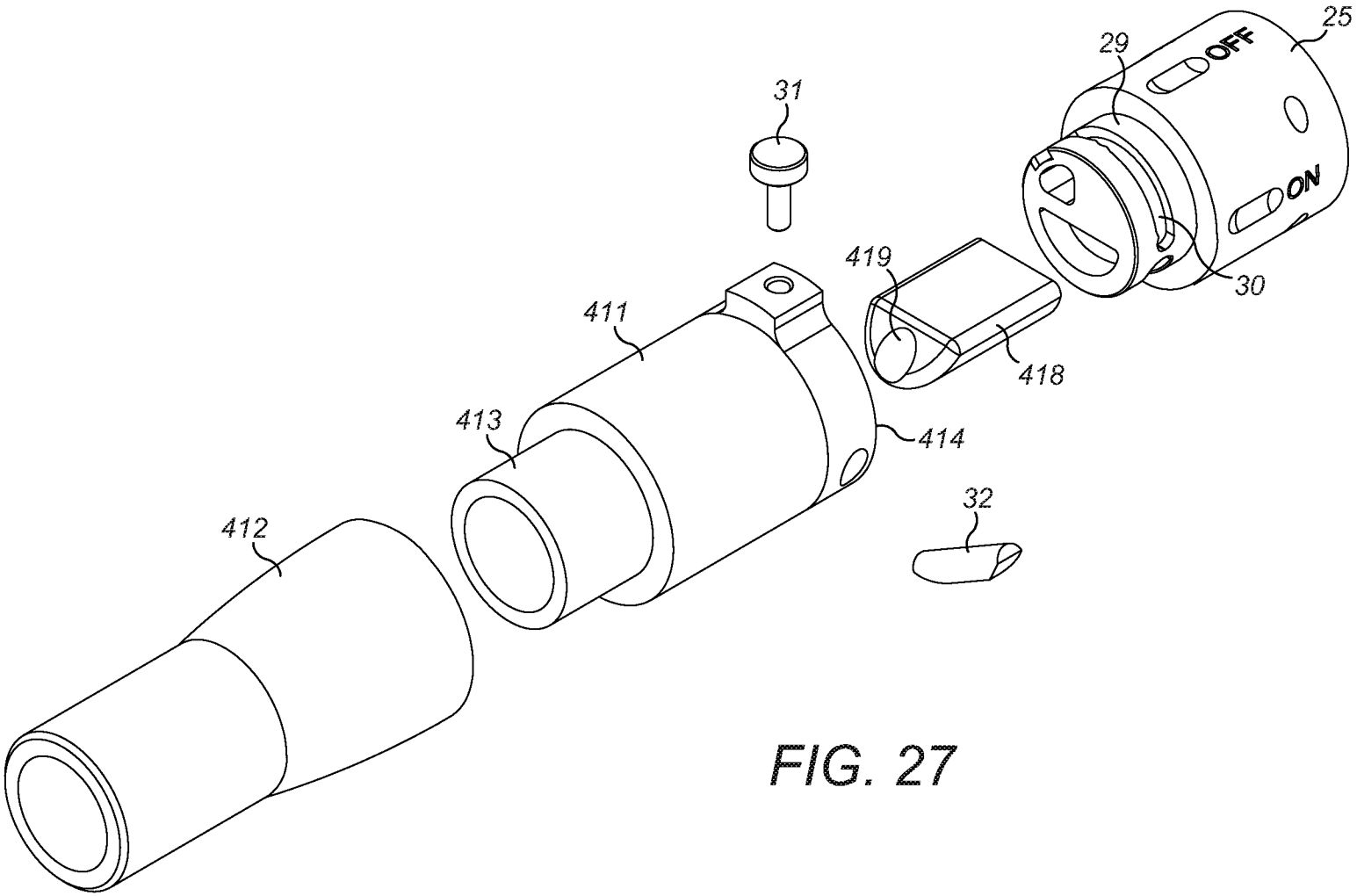
FIG. 27 shows an exploded perspective view of a part of an inhalation device including a connector, a mouthpiece and a component of a fifth embodiment.
Figure 28:
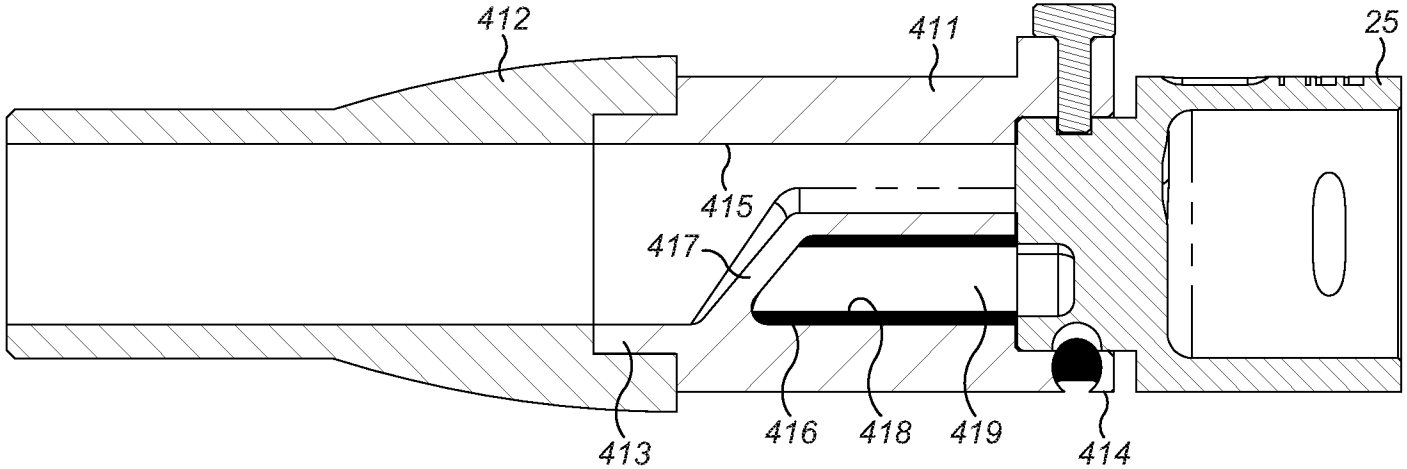
FIG. 28 shows a cross-sectional side view of the connector, component and mouthpiece of FIG. 27.

FIGS. 27 and 28 show a connector 25, a mouthpiece 412 and a component 411 of a smoking device of a fifth embodiment. The smoking device of the fifth embodiment is largely similar to that of the first embodiment shown in FIGS. 1-15 and like features retain the same reference numerals, including the hollow cylindrical connector 25 shown in FIGS. 27 and 28. Therefore, detailed description of identical components will not be repeated and are not shown again in subsequent figures.

One difference between the smoking device of the fifth embodiment and that of the first embodiment is that the mouthpiece 412 of the fifth embodiment is a simple hollow tube of tapering diameter and is not connected directly to the connector 25, and the mouthpiece 412 of the fifth embodiment does not include a blind cavity or contain any organoleptic material.

An intermediate component 411 is connected to the connector 25 around the projecting portion 29 by a cam pin 31 locating in the cam-groove 30, in the same way that the mouthpiece 12 of the first embodiment is connected to the connector 25, and the component 411 is similarly rotatable relative to the connector 25 between flavour "OFF" and "ON" positions. It is this component 411 that provides the organoleptic/flavour additive to the smoke stream in the same way as that of the mouthpiece 12 of the first embodiment. The rotational operation of the component 411 on the connector 25 of the fifth embodiment is the same as that of the mouthpiece 12 of the first embodiment, including the cam groove detents which provide stable rotational positions, ensuring an effective seal between the component 411 and connector 25 in the ON/OFF positions and providing a tactile feedback to the user.

The component 411 includes a first open end 413 which is connected to the mouthpiece 412 and through which smoke is drawn by a user, and a second open end 414 which receives the projecting portion 29 of the connector 25. A passage 415 communicates the first and second open ends 413, 414. The opening of the passage 415 is semi-circular at the second open end 414 and is disposed at the upper portion of the component 411 only. The second open end 414 includes a recess 416, separate from the passage 415, in the form of a blind cavity that is closed by an end wall 417.

A body of organoleptic material 418 is disposed in the recess 416 to impart a flavour to smoke as the smoke stream passes over the body 41. The body 418 includes a cavity 419 extending therethrough.

In use of the smoking device of the fifth embodiment, a user has the option of whether or not flavourant is added to the smoke stream passing through the device. This is controlled in the same way as the first embodiment except that the component 411 is rotated relative to the connector 25 instead of the mouthpiece 12 being rotated relative to the connector 25. Therefore, detailed description of the modes of operation and fluid flow paths will not be repeated.

Replacement of the organoleptic body 418 when depleted after a predetermined number of tobacco rods 13 have been smoked may be achieved by removing the component 411 and replacement with a new component 411 having a fresh organoleptic body 418 therein. Alternatively, the organoleptic body 418 may be removable from the component 411 replaceable with a fresh one.

The mouthpiece 412 may be replaceable along with, or independently of, the component 411, as and when the user may desire. Alternatively, the mouthpiece 412 may be a premium long-term component of the smoking device that is kept with the body 11, and only the intermediate component 411 is replaced regularly. The mouthpiece 412 may make a friction fit on the component 411, as shown in FIGS. 27 and 28, or a cam pin/groove arrangement as between the component 411 and connector 25 may be provided.

The above-described embodiments comprise inhalation devices comprising smoking devices in which the inhalant comprises smoke generated from a combustible rod of smokable material inserted into the body of the device. However, the present invention is not intended to be limited to smoking devices and may include other types of inhalation devices such as vapour-generating devices, such as electronic cigarettes, or other devices which produce an inhalant such as a gas, vapour or aerosol for inhalation by a user. Such devices may heat tobacco by a heat source without combustion of the tobacco, to cause a vapour to be produced from the tobacco for inhalation by a user. Such heat source may comprise an electrical heating element or heat produced by alternative means. Alternatively, such devices may heat liquid held in a reservoir, such as a nicotine solution, to produce an inhalant in the form of a gas or vapour.

Figure 29:
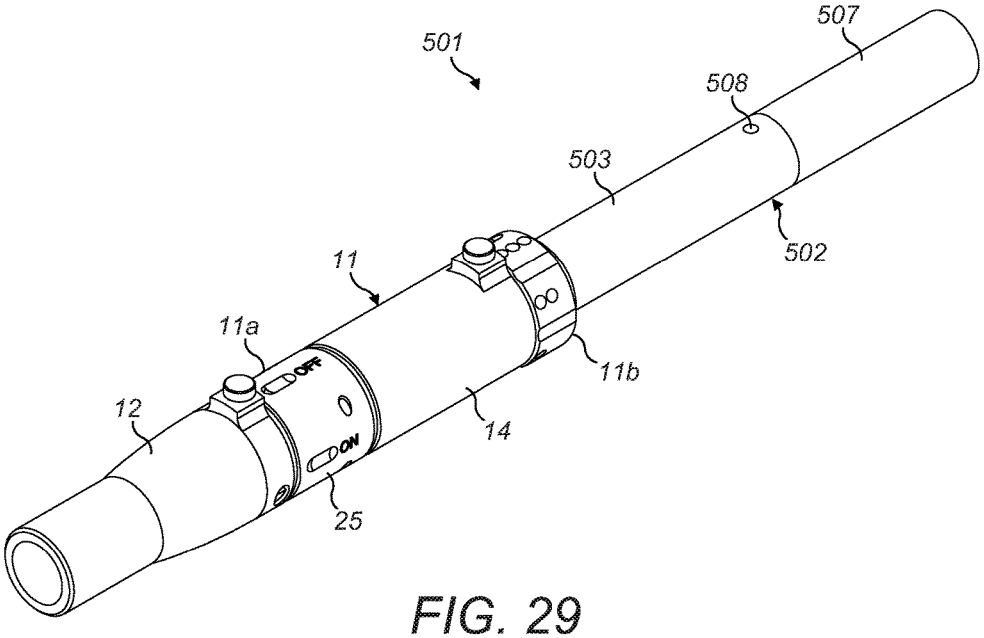
FIG. 29 shows a perspective view of an inhalation device of a sixth embodiment.
Figure 30:
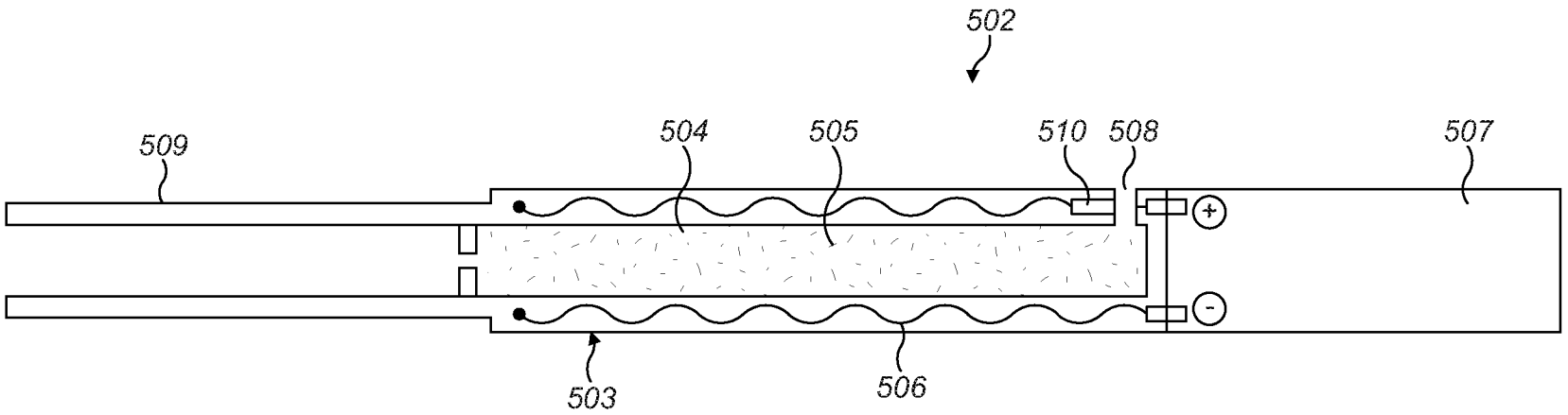
FIG. 30 shows a cross-sectional view through the inhalant-generating unit of the inhalation device of FIG. 29.

A sixth embodiment of an inhalation device 501 which does not operate by combustion to tobacco is show in FIGS. 29 and 30, and is similar to the first embodiment of FIGS. 1-15. Features of the controller body 11 and mouthpiece 12 which function to provide ventilation and flavour control are the same and so a description thereof will not be repeated. However, a difference between the sixth embodiment 501 and the first embodiment is that the device 501 of the sixth embodiment is not configured to receive a combustible tobacco rod and is not designed for smoke from combustion of a tobacco rod to be drawn through the inhalation device. Instead, the sixth embodiment 501 comprises a device in which tobacco is heated by a heat source to cause constituents of the tobacco to be released in a vapour phase to be drawn through the device and inhaled by a user. A vapour-generating unit 502 is connected to the second end **11*b* of the body 11 and comprises a cylindrical component 503 having a chamber 504 containing tobacco 505, and electrical heating elements 506 surrounding the chamber 504 configured to heat the tobacco 505 in the chamber 504. A power supply such as a battery 507 is provided at one end of the component 503 to provide power to the heating elements 506 and may be detachable from the rest of the component 503** for separate recharging.

An inlet orifice 508 is provided at one end of the component 503 in communication with the chamber 504 to allow air to be drawn into the chamber 504. An opposite end of the component 503 includes a connecting portion 509 configured to be received and retained within the second end **11*b* of the body 11. The chamber 504 is open at the connecting portion 509 so as to define a gas flow path through the inhalation device 501 when the vapour generating unit 502 is connected to the body 11, from the inlet orifice 508 to the mouthpiece 12. Therefore, air may be drawn into the chamber 504 via the inlet orifice 508, through the body 11 and the mouthpiece 12 when the user draws on the mouthpiece 12**.

A pressure sensor 510 is provided at the orifice 508 to detect when air is being drawn into the chamber 504 and the unit 502 is configured such that the heating elements 506 are powered when a reduced pressure is detected by the sensor 510 when air is being drawn into the chamber 504. A processor (not shown) may be provided in the component 503 to control operation of the heating elements 506 in response to signals from the pressure sensor 510.

In use, a user draws on the mouthpiece 12 which draws air through the inlet orifice 508 and into the chamber 504. The sensor 510 detects the reduced pressure at the inlet orifice 508 and the heating elements 506 are powered, heating the tobacco 505 and caused vapour phase products to be released from the tobacco 505. The released vapour is then drawn out of the chamber 504 through the connecting portion 509, through the body 11 and mouthpiece 12 and is inhaled by the user. When the user stops drawing on the mouthpiece, the return to ambient pressure is detected by the sensor 510 and power to the heating elements 506 is stopped, stopping further heating of the tobacco until the user next draws on the mouthpiece.

As a user uses the inhalation device 501 of the sixth embodiment, they may choose to turn additional flavour on or off as described previously by rotation of the mouthpiece 12, and may also allow varying degrees of ambient external ventilation air into the vapour stream, to dilute and/or cool the vapour steam as desired, by rotation of the ventilation control sleeve 17 as described above.

Upon exhaustion of the tobacco source 505 in the vapour-generating unit 502, the unit 502 may be detached from the body by the ejection mechanism described above, or simply by being pulled out of the body, and replaced with a fresh unit. The component 503 portion of the vapour-generating unit 502 may be replaced with a new component 503 with a fresh full chamber 504 of tobacco 505, separately to replacement of the battery 507.

Figure 31:
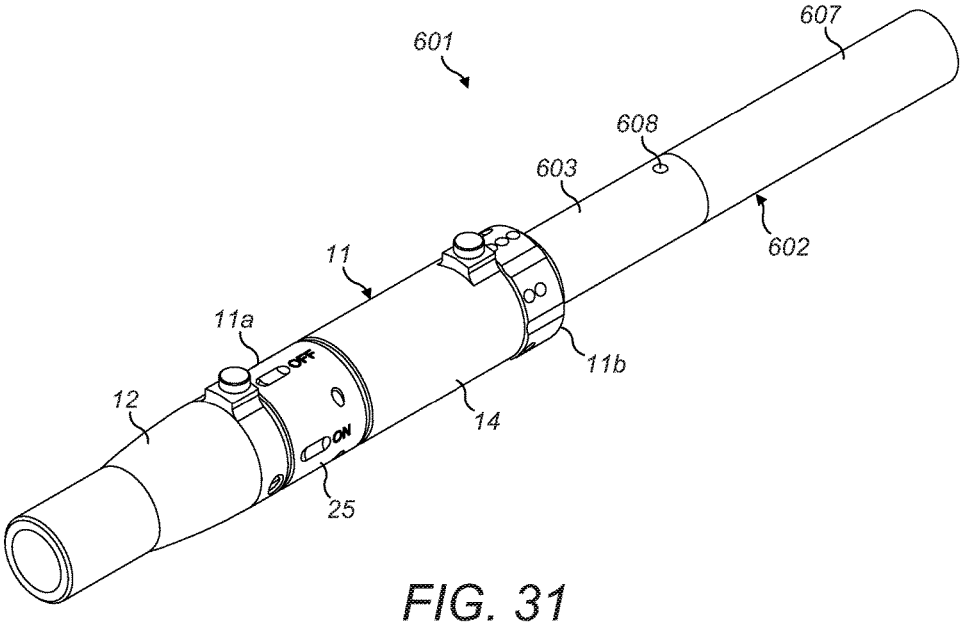
FIG. 31 shows a perspective view of an inhalation device of a seventh embodiment.
Figure 32:
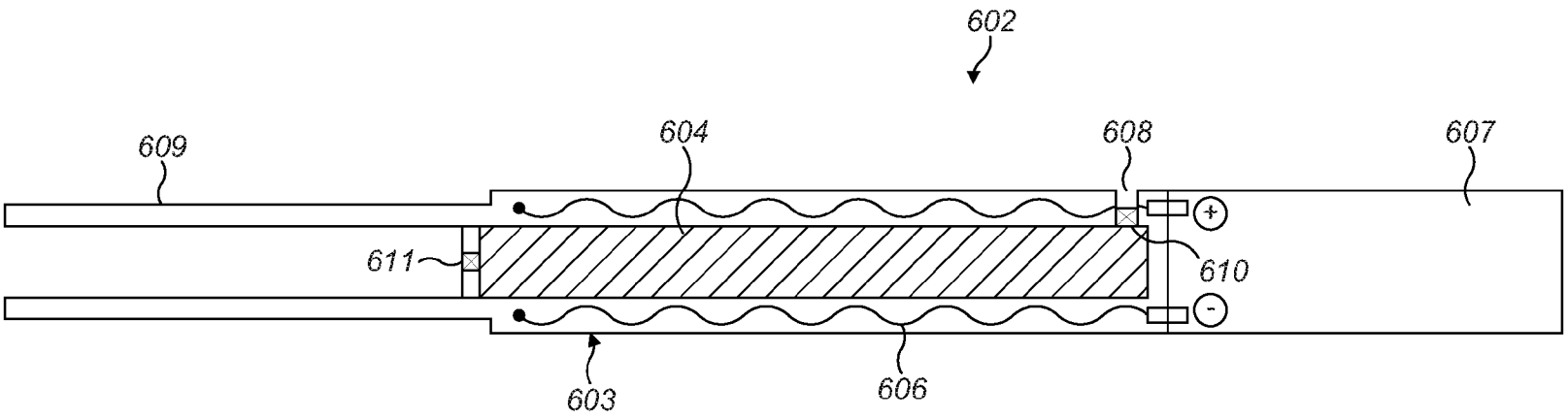
FIG. 32 shows a cross-sectional view through the inhalant-generating unit of the inhalation device of FIG. 31.

A seventh embodiment of an inhalation device 601 which also does not operate by combustion to tobacco is show in FIGS. 31 and 32, and is similar to the sixth embodiment of FIGS. 29 and 30. Like features retain the same reference numerals and detailed description thereof will not be repeated. As with the sixth embodiment, the seventh embodiment is not configured to receive a combustible tobacco rod or for smoke from combustion of a tobacco rod to be drawn through the device. However, a difference between the seventh embodiment 601 and the sixth embodiment is that the device 601 of the seventh embodiment includes a different configuration of vapour-generating unit 602 connected to the second end 11*b* of the body 11. Here, the vapour generating unit 602 comprises a cylindrical component 603 having a chamber 604 containing nicotine solution, and electrical heating elements 606 surrounding the chamber 604 configured to heat the solution in the chamber to produce nicotine vapour. A power supply such as a battery 607 is provided at one end of the component 603 to provide power to the heating elements 606 and may be detachable from the rest of the component 603 for separate recharging.

An inlet orifice 608 is provided at one end of the component 603 in communication with the chamber 604 to allow air to be drawn into the chamber 604. The inlet orifice 608 may include a one-way valve 610. An opposite end of the component 603 includes a connecting portion 609 configured to be received and retained within the second end 11*b* of the body 11. The connecting portion 609 includes an open end and the chamber may include a one-way outlet valve 611 so that generated vapour may pass out of the chamber 604. A gas flow path can thereby be defined through the inhalation device 601 when the vapour generating unit 602 is connected to the body 11, from the inlet orifice 608 to the mouthpiece 12. Therefore, air may be drawn into the chamber 604 via the inlet orifice 608, through chamber 604, through the body 11 and the mouthpiece 12 when the user draws on the mouthpiece 12.

As with the sixth embodiment, a pressure sensor (not shown) may be provided at the orifice 608 to detect when air is being drawn into the chamber 604 and connected to a processor (not shown) to control the heating elements 606 to only be powered when a reduced pressure is detected by the sensor when air is being drawn into the chamber 604 by a user drawing on the mouthpiece.

In use, a user draws on the mouthpiece 12 which draws air though the inlet orifice 608 and into the chamber 604. The heating elements 606 are powered, heating the nicotine solution to generate nicotine vapour which is drawn out of the chamber 604 through the outlet valve 611, through the connecting portion 609, through the body 11 and mouthpiece 12 and is inhaled by the user.

In use of the inhalation device 601 of the seventh embodiment, the user may choose to turn additional flavour on or off as described previously by rotation of the mouthpiece 12, and may also allow varying degrees of ambient external ventilation air into the vapour stream, to dilute and/or cool the vapour steam as desired, by rotation of the ventilation control sleeve 17 as described above.

Upon exhaustion of the nicotine solution supply in the vapour-generating unit 602, the unit 602 may be detached from the body by the ejection mechanism described above, or simply by being pulled out of the body, and replaced with a fresh unit. The component 603 with fresh full chamber 604 may be replaced separately to the battery.

Although in the seventh embodiment, a flow path is described as extending from the inlet orifice 608, through the chamber 604 and through the connecting portion 609 into the body 11, in an alternative embodiment, ambient air may flow from the inlet orifice 608 into the component 603 but may flow within the component 603 in a passage that bypasses the chamber 604 and leads into the connecting portion 609. The chamber 604 may include a single outlet aperture, which may be provided with a one-way valve, through which vapour, generated by heating of the liquid within the chamber 604 by the heating elements 606, is expelled, to mix with the ambient air from the bypass passage, before being drawn through the body 11 of the inhalation device.

In the sixth and seventh embodiments described above, the inhalant-generating components are described as being removeably received in the body 11 of the inhalant device. However, it is intended within the scope of the invention that such inhalant-generating components may alternatively be formed integrally with the body and the entire device/apparatus may be discarded after use or once the inhalant-generating component is exhausted.

As used herein, the term inhalant may include smoke, aerosols, vapours or gases suitable for inhalation by a user.

As used herein, the terms "flavour" and "flavourant" refer to materials which, where local regulations permit, may be used to create a desired taste or aroma in a product for adult consumers. They may include extracts (e.g., liquorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder In order to address various issues and advance the aft, the entirety of this disclosure shows by way of illustration various embodiments in which the claimed invention(s) may be practiced and provide for superior inhalation device and component for an inhalation device. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An inhalation device component, comprising:

a first end configured to connect to a body of an inhalation device;

a second end; and a passage extending through the inhalation device component from the first end to the second end and configured to receive a flow of inhalant therethrough, the first end defining a blind cavity therein, separate from the passage and containing an organoleptic material, the blind cavity configured to receive the flow of inhalant to impart an organoleptic property to the inhalant as the inhalant passes over the organoleptic material.

2. The inhalation device component according to claim 1, wherein the organoleptic material includes at least one open hollow space defined therein.

3. The inhalation device component according to claim 1, further comprising a cam pin that projects inwardly from an inside wall of the inhalation device component and is proximate the first end and configured to locate in a corresponding cam groove in a body of a smoking device to connect the inhalation device component to the smoking device.

4. The inhalation device component according to claim 1, wherein the organoleptic material is disposed within a casing within the blind cavity.

5. The inhalation device component according to claim 1, wherein the organoleptic material is removable from the inhalation device component to enable replacement with another portion of organoleptic material.

6. The inhalation device component according to claim 1, further comprising a removable cover sealed over the blind cavity to seal the organoleptic material from ambient atmosphere prior to use.

7. The inhalation device component according to claim 1, further comprising a mouthpiece.

8. An inhalation device, comprising:

an inhalation device component comprising:

a first end configured to connect to a body of the inhalation device, a second end, and a passage extending through the inhalation device component from the first end to the second end and configured to receive a flow of inhalant therethrough, the first end defining a blind cavity therein, separate from the passage and containing an organoleptic material, the blind cavity configured to receive the flow of inhalant to impart an organoleptic property to the inhalant as the inhalant passes over the organoleptic material; and a body including:

a first end configured to receive the inhalation device component, a second end configured to receive an inhalant generator, and a conduit extending through the body between the first end and the second end.

9. The inhalation device according to claim 8, wherein the inhalation device component is positionable relative to the body in a first position wherein the conduit is in fluid communication with the passage via the blind cavity, thereby defining a first inhalant flow path through the inhalation device in which an organoleptic additive may be introduced into the inhalant stream in use.

10. The inhalation device according to claim 9, wherein the organoleptic material includes at least one open hollow space defined therein, and the first inhalant flow path extends through the open hollow space in the organoleptic material.

11. The inhalation device according to claim 9, wherein the inhalation device component is moveable relative to the body between the first position and a second position in which the conduit is in fluid communication with the passage to define a second inhalant flow path through the inhalation device, and in which the blind cavity is sealed from the conduit and the passage to prevent introduction, in use, of an organoleptic additive into the inhalant stream.

12. The inhalation device according to claim 11, wherein the second inhalant flow path bypasses the organoleptic material.

13. The inhalation device according to claim 11, wherein the inhalation device component is rotatable relative to the body between the first and second positions.

14. The inhalation device according to claim 13, wherein the inhalation device component further comprises a cam pin that projects inwardly from an inside wall of the inhalation device component and is proximate the first end and configured to locate in a corresponding cam groove in a body of a smoking device to connect the inhalation device component to the smoking device, and the first end of the body includes a cam groove along which the cam pin travels as the inhalation device component is rotated between the first and second positions.

15. The inhalation device according to claim 14, wherein the cam groove further includes a detent configured to receive a cam pin to provide a stable rotational position of the inhalation device component relative to the body when in at least one of the first and second positions.

16. The inhalation device according to claim 15, wherein the cam groove is configured such that the inhalation device component is urged into tighter engagement with the body when the cam pin is received in the detent than when the cam pin is located in the remainder of the cam groove.

17. The inhalation device according to claim 9, wherein, in use, inhalant passing along the first inhalant flow path sweeps over the surface of the organoleptic material as it flows within the blind cavity when the component is in the first position.

18. The inhalation device according to claim 9, wherein the first end of the body includes an end face through which the conduit extends, the end face defining a recess, the recess in the end face configured to permit fluid communication between the blind cavity in the inhalation device component and the passage in the inhalation device component when the inhalation device component is in the first position.

19. The inhalation device according to claim 9, wherein the first end of the body includes an end face through which the conduit extends, the end face defining a recess, the blind cavity in the inhalation device component configured to permit fluid communication between the conduit and the recess in the end face, when the inhalation device component is in the first position.

20. The inhalation device according to claim 9, wherein the organoleptic material defines at least one open hollow space therewithin, and the conduit is in fluid communication with the passage via the at least one open hollow space in the organoleptic material when the inhalation device component is in the first position.

21. The inhalation device according to claim 9, further comprising a ventilation control mechanism configured to, in use, selectively allow ambient air to be drawn into the body to mix with the inhalant stream.

22. The inhalation device according to claim 21, wherein control of the introduction of ambient air by the ventilation control mechanism is independent of a selective introduction of an organoleptic additive into the inhalant stream.

23. The inhalation device according to claim 8, further comprising a smoking device configured to receive a rod of smokable material to generate smoke as an inhalant to be drawn through the device by combustion of the tobacco rod.

24. The inhalation device according to claim 8, wherein the inhalation device is configured to receive a vapor generator, the vapor generator including tobacco and a heat generator configured to, in use, heat the tobacco without combustion, thereby generating inhalant vapor to be drawn through the device.

25. The inhalation device according to claim 8, wherein the inhalation device is configured to receive a vapor generator including a reservoir of liquid and a heat generator configured to, in use, heat the liquid-such that inhalant vapor is generated.

26. A pack comprising:

a plurality of inhalation device components, each of the plurality of inhalation device components comprising:

a first end configured to connect to a body of an inhalation device, a second end, and a passage extending through the inhalation device component from the first end to the second end and configured to receive a flow of inhalant therethrough, the first end defining a blind cavity therein, separate from the passage and containing an organoleptic material, the blind cavity configured to receive the flow of inhalant to impart an organoleptic property to the inhalant as the inhalant passes over the organoleptic material.

27. The pack according to claim 26, wherein the pack is hermetically sealed.

28. The pack according to claim 27, wherein each inhalation device component of the plurality of inhalation device components is individually hermetically sealed from the remaining inhalation device components.

29. The pack according to claim 26, wherein each of the plurality of inhalation device components comprises a mouthpiece.

* * * * *